US012789036B2

(12) United States Patent
Hall et al.

(10) Patent No.: US 12,789,036 B2
(45) Date of Patent: Nov. 10, 2026

(54) ATHLETIC SYSTEMS

(71) Applicant: NIKE, Inc., Beaverton, OR (US)

(72) Inventors: Zachary T. Hall, Lake Oswego, OR (US); Carter R. Pahl, Lake Oswego, OR (US); Gabrielle A. Rudd, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 39 days.

(21) Appl. No.: 19/081,578

(22) Filed: Mar. 17, 2025

(65) Prior Publication Data

US 2025/0288855 A1 Sep. 18, 2025

Related U.S. Application Data

(60) Provisional application No. 63/565,996, filed on Mar. 15, 2024.

(51) Int. Cl.
*A63B 21/00* (2006.01)

(52) U.S. Cl.
CPC .... *A63B 21/4033* (2015.10); *A63B 2225/105* (2013.01)

(58) Field of Classification Search
CPC ... A63B 21/068; A63B 21/08; A63B 21/4027; A63B 21/4029; A63B 21/4033; A63B 21/4039; A63B 21/4049; A63B 26/00; A63B 26/003; A63B 69/0057; A63B 69/0062; A63B 2208/0209; A63B 2208/0242; A63B 2208/0257; A63B 2225/09; A63B 2225/105; A63B 2244/09
See application file for complete search history.

(56) References Cited

U.S. PATENT DOCUMENTS

| | | | | |
|---|---|---|---|---|
| 5,176,603 | A * | 1/1993 | Hundley | A63B 21/4029 482/145 |
| 6,746,384 | B2 * | 6/2004 | Cole | A63B 23/0233 482/130 |
| 12,370,399 | B1 * | 7/2025 | Gong | A63B 21/4029 |
| 2007/0281841 | A1 * | 12/2007 | Gates | A63B 21/4029 482/142 |
| 2024/0399195 | A1 * | 12/2024 | Iverson | A63B 17/04 |

FOREIGN PATENT DOCUMENTS

| | | | | |
|---|---|---|---|---|
| WO | WO-2025096808 | A1 * | 5/2025 | A63B 21/4029 |

* cited by examiner

*Primary Examiner* — Gary D Urbiel Goldner
(74) *Attorney, Agent, or Firm* — BOOKOFF MCANDREWS PLLC

(57) ABSTRACT

A weight-training apparatus with a chest pad, a roller, and a collar positioned between and coupled to the chest pad and to the roller. The chest pad is movable relative to the collar. A mounting arm is coupled to the chest pad, the collar, and the roller. The mounting arm is coupled to an ancillary device such that the chest pad and the roller are suspended relative to the ancillary device.

20 Claims, 18 Drawing Sheets

ATHLETIC SYSTEMS

CROSS-REFERENCE TO RELATED APPLICATION(S)

This patent application claims the benefit of priority to U.S. Provisional Patent Application No. 63/565,996, filed on Mar. 15, 2025, the entirety of which is incorporated herein by reference.

TECHNICAL FIELD

The present invention relates in general to athletic systems, and more particularly, to a weight lifting system including an integrated assembly of a chest pad and a roller.

BACKGROUND

Athletes performing exercises, such as for weightlifting training, may use a chest support for chest exercises, and then move to a different piece of equipment for squatted exercises or other leg exercises when completing sets of exercises. Using more than one piece of equipment during a training session may negatively impact rest times and focus between sets of exercises. For athletes that prefer to train using a home gym, storage space is often one of the largest limiting factors. Equipment that efficiently use space and reduce the amount of area needed enables an athlete to have an effective home gym. Athletes may also require minimal extraneous movements when exercising and setting exercises. Moreover, when at an exercise facility, an athlete may prefer to stay in one area during a training session instead of having to move to a separate area to use a different piece of equipment. Staying in one area may allow the athlete to store personal belongings in one area instead of having to remember to bring personal belongings to each piece of equipment.

SUMMARY OF THE DISCLOSURE

In some aspects, the techniques described herein relate to a weight-training apparatus including: a chest pad; a roller; a collar positioned between the chest pad and the roller, wherein the collar couples the chest pad to the roller, and wherein the chest pad is movable relative to the collar; and a mounting arm configured to couple the chest pad, the collar, and the roller to an ancillary device such that the chest pad and the roller are suspended relative to the ancillary device.

In some aspects, the techniques described herein relate to a weight-training apparatus, wherein the mounting arm is disposed at a first end of the weight-training apparatus and the chest pad is disposed at a second end of the weight-training apparatus opposite the first end, the mounting arm configured to engage the ancillary device.

In some aspects, the techniques described herein relate to a weight-training apparatus, wherein the mounting arm includes: a brace plate having a longitudinal length defined between a first bracket of the mounting arm and a second bracket of the mounting arm; a first flange extending laterally outwards from an upper portion of the mounting arm and opposite of the roller; and a second flange extending laterally outwards from a lower portion of the mounting arm and opposite of the roller.

In some aspects, the techniques described herein relate to a weight-training apparatus, further including: a support pin fixedly attached to the mounting arm, wherein the brace plate includes a first opening configured to receive the support pin to couple the weight-training apparatus to the ancillary device.

In some aspects, the techniques described herein relate to a weight-training apparatus, further including: a pin removably attached to the mounting arm, wherein the brace plate includes a second opening configured to receive the pin to couple the weight-training apparatus to the ancillary device.

In some aspects, the techniques described herein relate to a weight-training apparatus, further including: a first handle extending from the collar, wherein a longitudinal length of the first handle extends perpendicular to a longitudinal axis of the weight-training apparatus; and a second handle extending from the mounting arm, wherein a longitudinal length of the second handle extends parallel to the longitudinal axis.

In some aspects, the techniques described herein relate to a weight-training apparatus, wherein each of the chest pad and the roller includes a foam material.

In some aspects, the techniques described herein relate to a weight-training apparatus, further including: a support frame extending between a first end and a second end, the support frame including: a first arm; a second arm parallel to the first arm; and one or more support braces coupling the first arm to the second arm, wherein the first end of the support frame is connected to or formed with the mounting arm, and wherein the second end of the support frame is connected to or formed with the collar.

In some aspects, the techniques described herein relate to a weight-training apparatus, further including: a roller arm extending from a first end to a second end; a first I-beam; and a second I-beam, wherein the roller arm is coupled to the roller, wherein the roller arm is a hollow tube, wherein the first I-beam extends into the roller arm from the first end such that the first I-beam terminates closer to the first end than a center of the roller arm, wherein the second I-beam extends into the roller arm from the second end such that the second I-beam terminates closer to the second end than the center of the roller arm, and wherein the roller arm is included of steel.

In some aspects, the techniques described herein relate to a weight-training apparatus including: a chest support system including; a collar including a pair of arms, each of the pair of arms including a plurality of holes; a chest pad movably coupled to the collar via a connection joint, the connection joint including a plurality of holes; and a pin disposed within corresponding holes of the plurality of holes of the pair of arms and a first hole of the plurality of holes of the connection joint; and a roller system including; a roller arm extending laterally outwards from the collar; and a roller circumferentially disposed around the roller arm.

In some aspects, the techniques described herein relate to a weight-training apparatus, wherein the roller includes a lumen extending through a longitudinal length of the roller, and the roller system includes a tube extending through the lumen.

In some aspects, the techniques described herein relate to a weight-training apparatus, wherein the tube is disposed around the roller arm in the lumen, and the roller is configured to rotate about the roller arm.

In some aspects, the techniques described herein relate to a weight-training apparatus, wherein the chest pad is disposed in a first plane that is parallel to a longitudinal axis of the weight-training apparatus, and wherein the roller system is disposed in a second plane that is parallel to the longitudinal axis and offset from the first plane.

In some aspects, the techniques described herein relate to a weight-training apparatus including: a chest support system, the chest support system including; a collar including a first arm and a second arm, the first arm including one or more openings and the second arm including one or more openings; a chest pad configured to transition between a plurality of angular positions coupled to the collar via a connection joint, the connection joint including a first opening; and a pin configured to be removed or inserted within a first opening of the one or more openings of the first arm, a first opening of the one or more openings of the second arm, and the first opening of the connection joint; a mounting arm; a roller arm extending away from the mounting arm and coupled to the collar; and a roller circumferentially disposed around the roller arm.

In some aspects, the techniques described herein relate to a weight-training apparatus, wherein the connection joint includes a second opening, a third opening, and a fourth opening.

In some aspects, the techniques described herein relate to a weight-training apparatus, wherein the first opening corresponds to a first angular position of the chest pad, the second opening corresponds to a second angular position of the chest pad, the third opening corresponds to a third angular position of the chest pad, and the fourth opening corresponds to a fourth angular position of the chest pad.

In some aspects, the techniques described herein relate to a weight-training apparatus, wherein in the first angular position, the chest pad is positioned in a parallel configuration with a longitudinal axis of the weight-training apparatus, wherein in the second angular position, the chest pad is positioned in a transverse configuration that intersects the longitudinal axis, and wherein in the third angular position, the chest pad is positioned in a perpendicular configuration relative to the longitudinal axis.

In some aspects, the techniques described herein relate to a weight-training apparatus, wherein the chest pad is removably attached to the collar.

In some aspects, the techniques described herein relate to a weight-training apparatus, wherein each of the first arm and the second arm of the collar are substantially S-shaped such that the chest pad is disposed in a first plane that is offset from and elevated relative to a second plane of the roller.

In some aspects, the techniques described herein relate to a weight-training apparatus, the chest support system further including: a spring-loaded tube connected to the chest pad and the collar, wherein the chest pad is configured to move away from and towards the collar, and wherein the spring-loaded tube biases the chest pad to stay in contact with the spring-loaded tube.

Additional objects and advantages of the disclosed embodiments will be set forth in part in the description that follows, and in part will be apparent from the description, or may be learned by practice of the disclosed embodiments. The objects and advantages of the disclosed embodiments will be realized and attained by means of the elements and combinations particularly pointed out in the appended claims.

It is to be understood that both the foregoing general description and the following detailed description are exemplary and explanatory only and are not restrictive of the disclosed embodiments, as claimed.

BRIEF DESCRIPTION OF THE DRAWINGS

The detailed description of the invention will be described in relation to the accompanying drawings. In the drawings, the following figures have the following general nature.

Corresponding reference numerals indicate corresponding parts throughout the several views of the drawings.

DETAILED DESCRIPTION OF EMBODIMENTS

Figure 1:
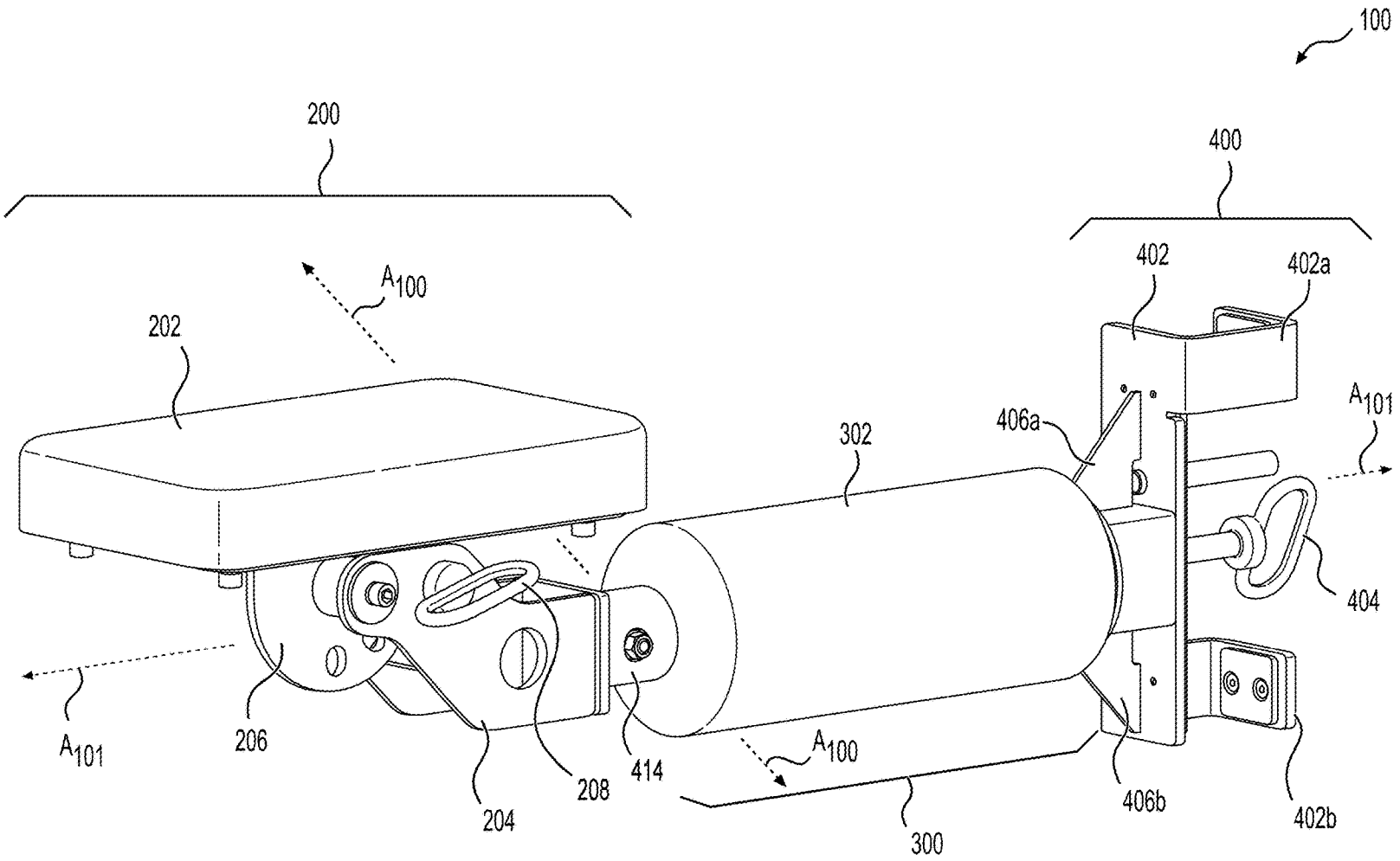
FIG. 1 is a perspective view of a consolidated weight-training apparatus, according to one or more embodiments.

The present disclosure overcomes the challenges described above and other known disadvantages with existing weight systems by providing a consolidated weight-training apparatus for performing multiple exercises.

Example configurations will now be described more fully with reference to the accompanying drawings. Example configurations are provided so that this disclosure will be thorough and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer, or section. Terms such as "first," "second," and other numerical terms do not imply a sequence or order unless clearly indicated by the context. Thus, a first element, component, region, layer, or section discussed below could be termed a second element, component, region, layer, or section without departing from the teachings of the example configurations. In the discussion that follows, terms "about," "approximately," "substantially," and the like, when used in describing a numerical value, denote a variation of +/−10% of that value, unless specified otherwise.

When an element or layer includes a directional and/or spatial term (e.g., top, bottom, medial, lateral, etc.), the directional and/or spatial term is used relative to when the consolidated weight-training apparatus is upright and flat, or attached to an ancillary device.

Traditional weight systems are isolated and designed for use during a single exercise. Aspects herein provide for a weight system, such as, for example, a consolidated weight-training apparatus, to allow a user to perform multiple exercises on a single apparatus and within a contained environment.

FIG. 1 depicts a consolidated weight-training apparatus 100. The consolidated weight-training apparatus 100 includes a chest support system 200, a roller system 300, and a mounting system 400. The chest support system 200 includes a chest pad 202, a collar 204, a connection joint 206, and a pin 208. The roller system 300 includes a roller 302 and a roller arm 304 (shown in FIG. 2). The mounting system 400 includes a mounting arm 402, a pair of brackets 402*a* and 402*b*, a pin 404, and a pair of flanges 406*a* and 406*b*. The consolidated weight-training apparatus 100 further includes a joint 414. The joint 414 connects roller system 300 and the chest support system 200 to each other. A lateral axis $A_{100}$ extends laterally through the consolidated weight-training apparatus 100. A longitudinal axis $A_{101}$ extends longitudinally through the consolidated weight-training apparatus 100 transversely (e.g., perpendicular) to the lateral axis $A_{100}$. In the example, the consolidated weight-training apparatus 100 is a unitary system meaning the consolidated weight-training apparatus 100 cannot (e.g., is not intended to) be detached into separate (e.g., one or more) components after assembly. In other examples, the consolidated weight-training apparatus 100 may be a modular system such that individual components of the system, such as the chest support system 200 or the roller system 300, may be removed from the consolidated weight-training apparatus 100.

Figure 2:
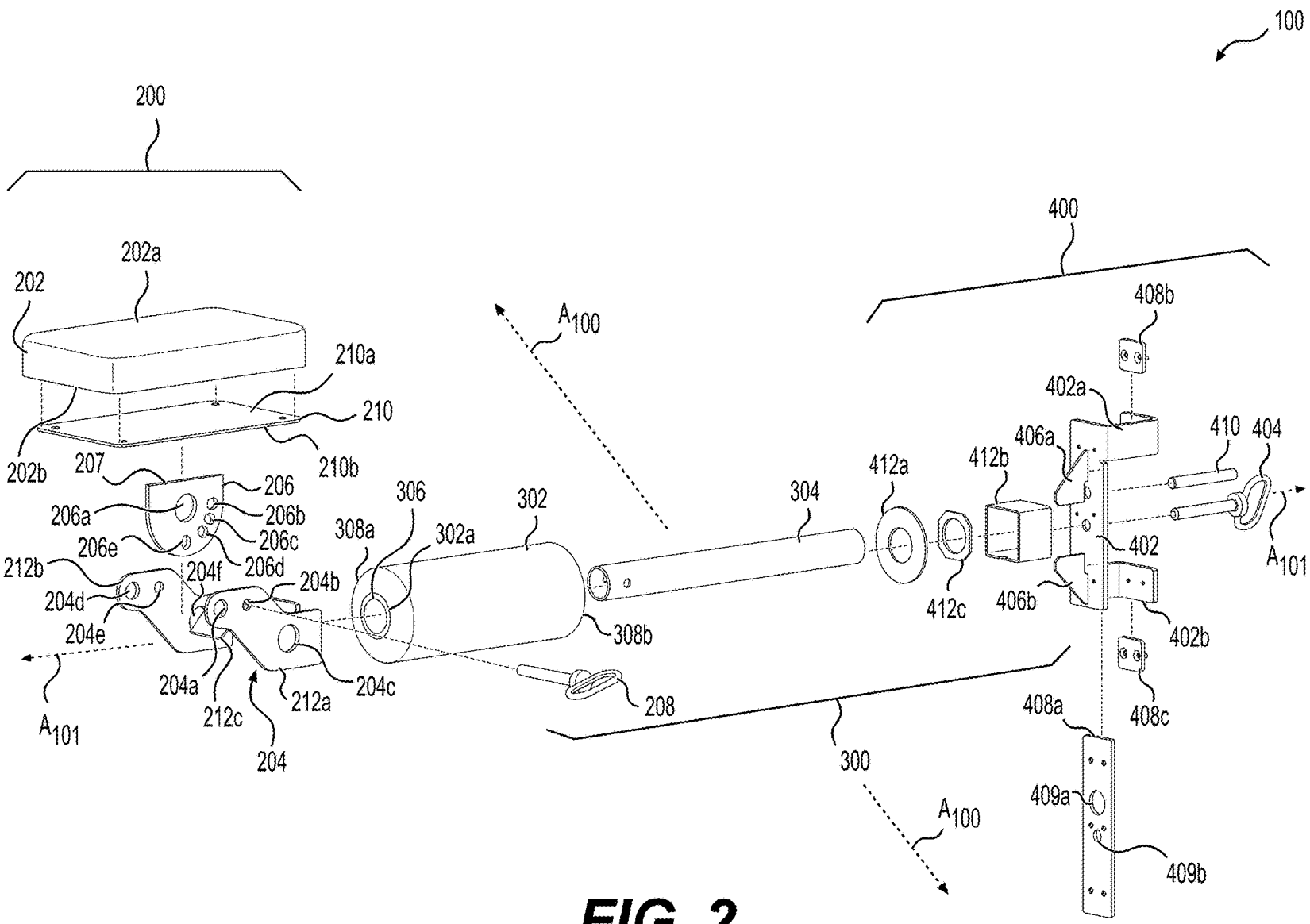
FIG. 2 is an exploded view of the consolidated weight-training apparatus of FIG. 1, according to one or more embodiments.

Referring to FIG. 2, an exploded view of the consolidated weight-training apparatus 100 is shown. The chest support system 200 further includes a plate 210. The plate 210 includes a first (upper) surface 210*a* and a second (lower) surface 210*b* opposite the first surface 210*a*. The chest pad 202 includes a first (upper) side 202*a* and a second (lower) side 202*b* opposite the first side 202*a*. The connection joint 206 includes a linear surface 207, a first opening 206*a*, a second opening 206*b*, a third opening 206*c*, a fourth opening 206*d*, and a fifth opening 206*e*. In an example, the first opening 206*a* includes a diameter that is larger than a diameter of the second opening 206*b*, the third opening 206*c*, the fourth opening 206*d*, and the fifth opening 206*e*. In an example, each of the second opening 206*b*, the third opening 206*c*, the fourth opening 206*d*, and the fifth opening 206*e* have the same diameter. In other examples, the first opening 206*a* includes a diameter that is smaller than a diameter of the second opening 206*b*, the third opening 206*c*, the fourth opening 206*d*, and the fifth opening 206*e*. In other examples, the first opening 206*a* includes a diameter that is the same as a diameter of the second opening 206*b*, the third opening 206*c*, the fourth opening 206*d*, and the fifth opening 206*e*. In other examples, one or more of the second opening 206*b*, the third opening 206*c*, the fourth opening 206*d*, and the fifth opening 206*e* have the same diameter while one or more others of the second opening 206*b*, the third opening 206*c*, the fourth opening 206*d*, and the fifth opening 206*e* have different diameters.

The collar 204 includes a first arm 212*a* and a second arm 212*b* that is positioned opposite of the first arm 212*a*. The first arm 212*a* is kinked so that it is substantially S-shaped (e.g., curvilinear). The second arm 212*b* is kinked so that it is substantially S-shaped (e.g., curvilinear). The first arm 212*a* and the second arm 212*b* are coupled to one another via a joint 212*c* that is positioned between the arms 212*a*, 212*b*. In an example, the respective shapes of the first arm 212*a* and the second arm 212*b* elevate the chest pad 202 to a plane that is offset from the roller system 300. In such an example, the chest pad 202 may be elevated such that it rests in a plane above the roller system 300. Such a configuration of the chest pad 202 and the roller system 300 moves a user's face away from the roller system 300 during use of the chest pad 202. In other examples, the chest pad 202 may rest in a plane that is even with the roller system 300. In other examples, the first arm 212*a* and the second arm 212*b* are substantially linear. The collar 204 further includes a plate 218 (shown in FIG. 3A). The plate 218 connects the first arm 212*a* and the second arm 212*b*. The plate 218 additionally couples the chest support system 200 to the roller system 300.

The first arm 212*a* includes a first opening 204*a*, a second opening 204*b*, and a third opening 204*c*. The first opening 204*a* and the second opening 204*b* are disposed on the first arm 212*a* at a common elevational position. In other words, the first opening 204*a* and the second opening 204*b* are disposed in a substantially similar plane as one another along the first arm 212*a*. The third opening 204*c* is disposed in a plane that is offset from the first opening 204*a* and the second opening 204*b*. The second arm 212*b* includes a fourth opening 204*d*, a fifth opening 204*e*, and a sixth opening 204*f*. The fourth opening 204*d* and the fifth opening 204*e* are disposed on the second arm 212*b* at a common elevational position. In other words, the fourth opening 204*d* and the fifth opening 204*e* are disposed in a substantially similar plane as one another along second arm 212*b*. The sixth opening 204*f* is disposed in a plane that is offset from the fourth opening 204*d* and the fifth opening 204*e*. The first arm 212*a* and the second arm 212*b* may include substantially similar sizes, shapes, and/or configurations as one another across the longitudinal axis $A_{101}$. As such, the respective openings of the first arm 212*a* are disposed directly opposite of respective openings of the second arm 212*b*. For example, first opening 204*a* of the first arm 212*a* is disposed directly opposite of the fourth opening 204*d* of the second arm 212*b* when the arms 212*a*, 212*b* are coupled to one another via joint 212*c*. The second opening 204*b* of the first arm 212*a* is disposed directly opposite of the fifth opening 204*e* of the second arm 212*b*, and the third opening 204*c* of the first arm 212*a* is disposed directly opposite of the sixth opening 204*f* of the second arm 212*b* when the arms 212*a*, 212*b* are coupled to one another.

In an example, the chest pad 202 is configured to move (e.g., pivot) forward and rearward relative to the collar 204. The coupling of the chest pad 202 to the connection joint 206 effects the movement of the chest pad 202 relative to the collar 204. The chest pad 202 moves parallel to the axis $A_{101}$.

Still referring to FIG. 2, the roller 302 includes a tube 306 and a lumen 302*a*, each of which have a longitudinal length that is substantially similar to one another. The roller 302 extends between a first end 308*a* and a second end 308*b* of the roller 302. The lumen 302*a* extends from the first end 308*a* to the second end 308*b*. The lumen 302*a* is hollow such as to allow for fluid (e.g., air) flow from the first end 308*a* to the second end 308*b* when not assembled. The lumen 302*a* is cylindrical in shape. The tube 306 is disposed within the lumen 302*a*. The tube 306 is cylindrical in shape and surrounds a volume of the lumen 302*a*. The tube 306 is hollow so as to receive other portions of the consolidated weight-training apparatus 100, as will be described further below. The tube 306 is configured to provide a rigid structure within the roller 302 to maintain a consistent shape of the roller 302 along its longitudinal length between the first end 308*a* and the second end 308*b*. In some examples, the roller 302 is configured without a tube 306. The roller system 300 is coupled with the chest support system 200 via the collar 204, as will be described further below.

In an example, the roller 302 is configured to rotate both clockwise and counterclockwise relative to the roller arm 304. In an example with the roller 302 including the tube 306, the tube 306 allows for more efficient rotation of the roller 302 about the roller arm 304. The roller 302 rotates about the axis $A_{101}$. The roller 302 may be used as a leg support during a variety of exercises, such as, for example, Bulgarian split squats. A user may also lay on the roller 302 with their chest or back in contact with roller 302 for other exercises, such as, for example glute bridges.

The mounting system 400 further includes a brace plate 408*a*, a first brace pad 408*b*, a second brace pad 408*c*, a support pin 410, a first washer 412*a*, a bracket 412*b*, and a second washer 412*c*. The brace plate 408*a* includes a first opening 409*a* and a second opening 409*b*. The brace plate 408*a* is disposed within an inner surface of the mounting arm 402. The first brace pad 408*b* is disposed on an inner surface of a first bracket 402*a*. In an example, the first brace pad 408*b* is disposed on a rearmost portion of the inner surface of the first bracket 402*a*. The second brace pad 408*c* is disposed on an inner surface of a second bracket 402*b*. In an example, the second brace pad 408*c* is disposed on a rearmost portion of the inner surface of the second bracket 402*b*. The pin 404 is configured to engage an external equipment or ancillary device and rest within an inner boundary of the second opening 409*b*. The pin 404 includes a handle such that a user can easily remove the pin 404 from the mounting system 400 and/or add the pin 404 to mounting system 400. The support pin 410 is also configured to engage the external equipment and rest within an inner boundary of the first opening 409*a*. The support pin 410 is fixedly attached to the mounting system 400 (e.g., to mounting arm 402). In an example, the mounting system 400 is configured to receive a portion of the external equipment between the mounting arm 402. Namely, the portion of the external equipment is received between the first bracket 402*a* and the second bracket 402*b*. The pin 404 and the support pin 410 extend through the portion of the external equipment to securely attach the mounting system 400 to the external equipment. In such an example, the mounting system 400 provides a cantilever configuration for supporting the roller system 300 and the chest support system 200 as the weight-training apparatus 100 is only fixed at one end via the mounting system 400. The chest support system 200 and the roller system 300 project outward and away from the external equipment from the fixed end.

In an example, the consolidated weight-training apparatus 100 is attached to an upright (e.g., a box beam) of a power rack (e.g., external equipment). To attach the consolidated weight-training apparatus 100 to the upright, a user rotates the consolidated weight-training apparatus 100 90 degrees such that the mounting arm 402 is extending horizontally instead of vertically. The support pin 410 is then received by one of the through holes of the upright. Once the support pin 410 is within one of the through holes, the consolidated weight-training apparatus 100 is then rotated 90 degrees back to the starting orientation, causing the first bracket 402*a* and the second bracket 402*b* to cup and contact the upright. Thus, the first bracket 402*a* and the second bracket 402*b* restrict translational movement away from the upright (e.g., the consolidated weight-training apparatus 100 cannot be pulled away from the upright). The pin 404 is then placed through another one of the through holes of the upright and through the second opening 409*b*. Because the consolidated weight-training apparatus 100 is now secured to the upright at two locations, the consolidated weight-training apparatus 100 can no longer rotate with respect to the upright. The support pin 410 and the pin 404, together, restrict rotational movement between the consolidated weight-training apparatus 100 and the upright. The consolidated weight-training apparatus 100 is suspended relative to and connected to the upright. To remove the consolidated weight-training apparatus 100 from the upright, a user may pull the pin 404 out of the other through hole of the upright, rotate the consolidated weight-training apparatus 100 90 degrees, and remove the support pin 410 from the through hole.

The first washer 412*a*, the bracket 412*b*, and the second washer 412*c* are coupled to one another to form a receptacle for the roller arm 304 when fully assembled with the mounting system 400. Each of the flanges 406*a*, 406*b* is adhered to and integrally formed with the mounting arm 402. The flange 406*a* is disposed closer to the first bracket 402*a* than the second bracket 402*b*. The flange 406*b* is disposed closer to the second bracket 402*b* than the first bracket 402*a*. The flange 406*a* and the flange 406*b* provide additional reinforcement for the mounting system 400. The first washer 412*a*, the bracket 412*b*, and the second washer 412*c* are disposed between the first flange 406*a* and the second flange 406*b*. In an example, the bracket 412*b* is sized to fit between and engage each of flange 406*a* and 406*b*. The bracket 412*b* is securely fixed to the mounting arm 402 between the flange 406*a* and 406*b*. The roller arm 304 is configured to be secured within the bracket 412*b* and secured via the first washer 412*a*. In an example, the first washer 412*a* abuts the second end 308*b* of the roller 302, as shown in FIGS. 3B and 3C. In the example, the first washer 412*a* reduces damage of the roller 302 from the flange 406*a* and the flange 406*b*.

As shown in FIG. 2, the second side 202*b* of the chest pad 202 is adhered or coupled to the first surface 210*a* of the plate 210, such as, for example, via one or more fastening mechanisms (e.g., screws, bolts, etc.). In other embodiments, the second side 202*b* of the chest pad 202 may be adhered or coupled to the first surface 210*a* of the plate 210 via gluing, adhesives, thermal bonding or welding, or any other suitable means for connecting a pad to a plate. Thus, the chest pad 202 and the plate 210 are fixedly attached to one another. The second surface 210*b* of the plate 210 is fixedly attached to the linear surface 207 of the connection joint 206 via gluing, adhesives, thermal bonding or welding, or any other suitable means for connecting two or more rigid materials.

Figure 3A:
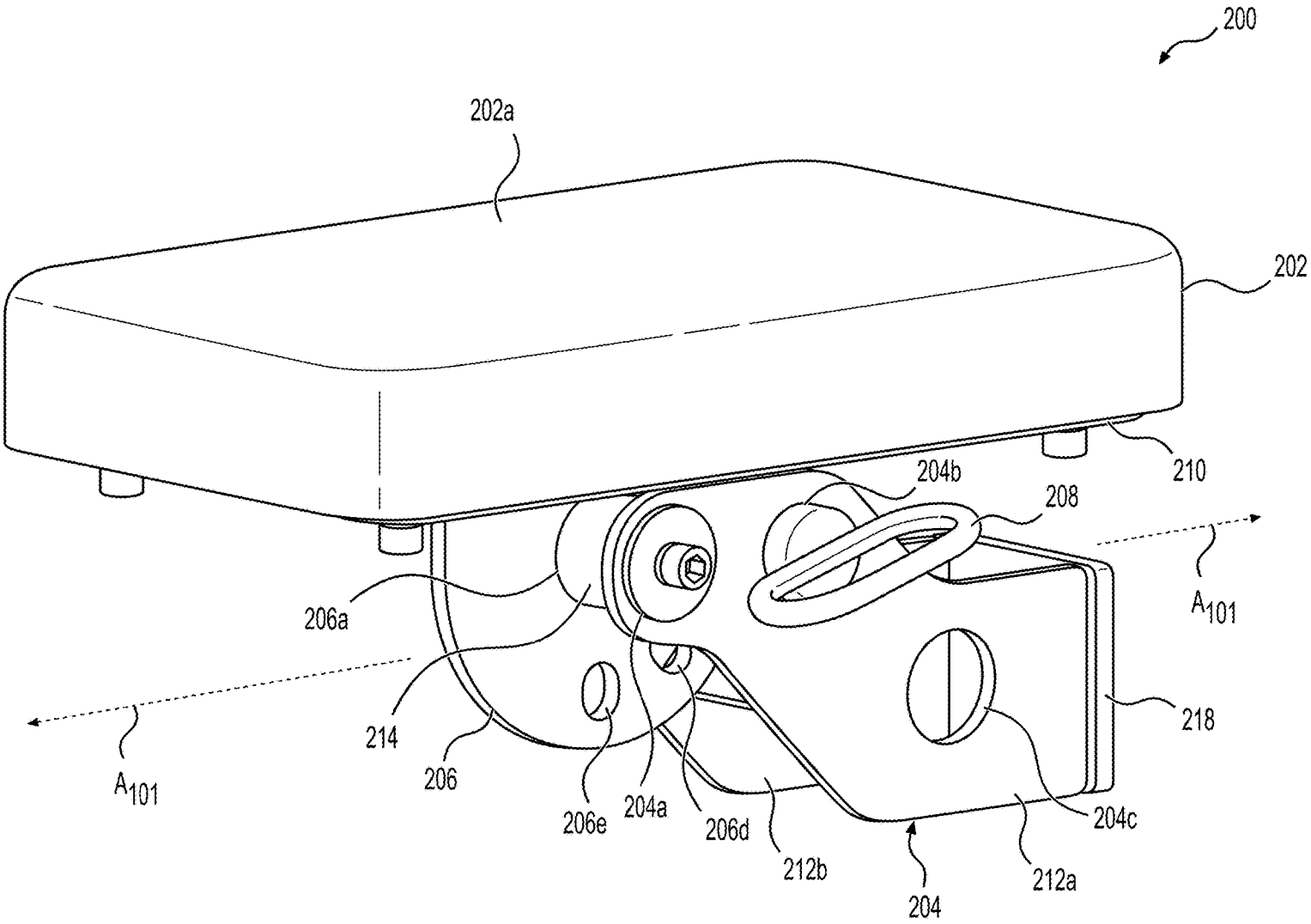
FIG. 3A is a perspective view of the consolidated weight-training apparatus of FIG. 1 with a chest pad in a first configuration, according to one or more embodiments.
Figure 3B:
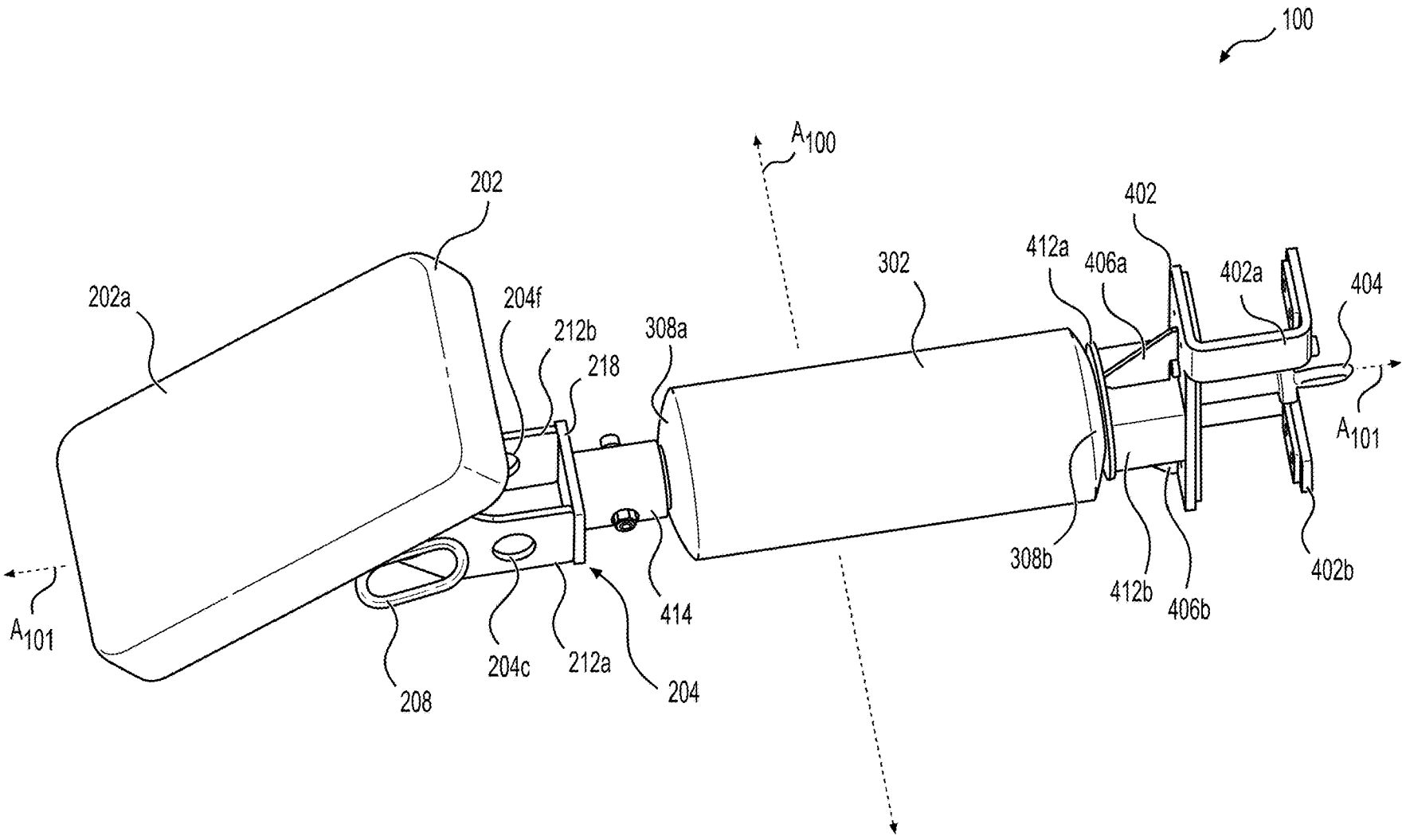
FIG. 3B is a perspective view of the consolidated weight-training apparatus of FIG. 1 with the chest pad in a second configuration, according to one or more embodiments.
Figure 3C:
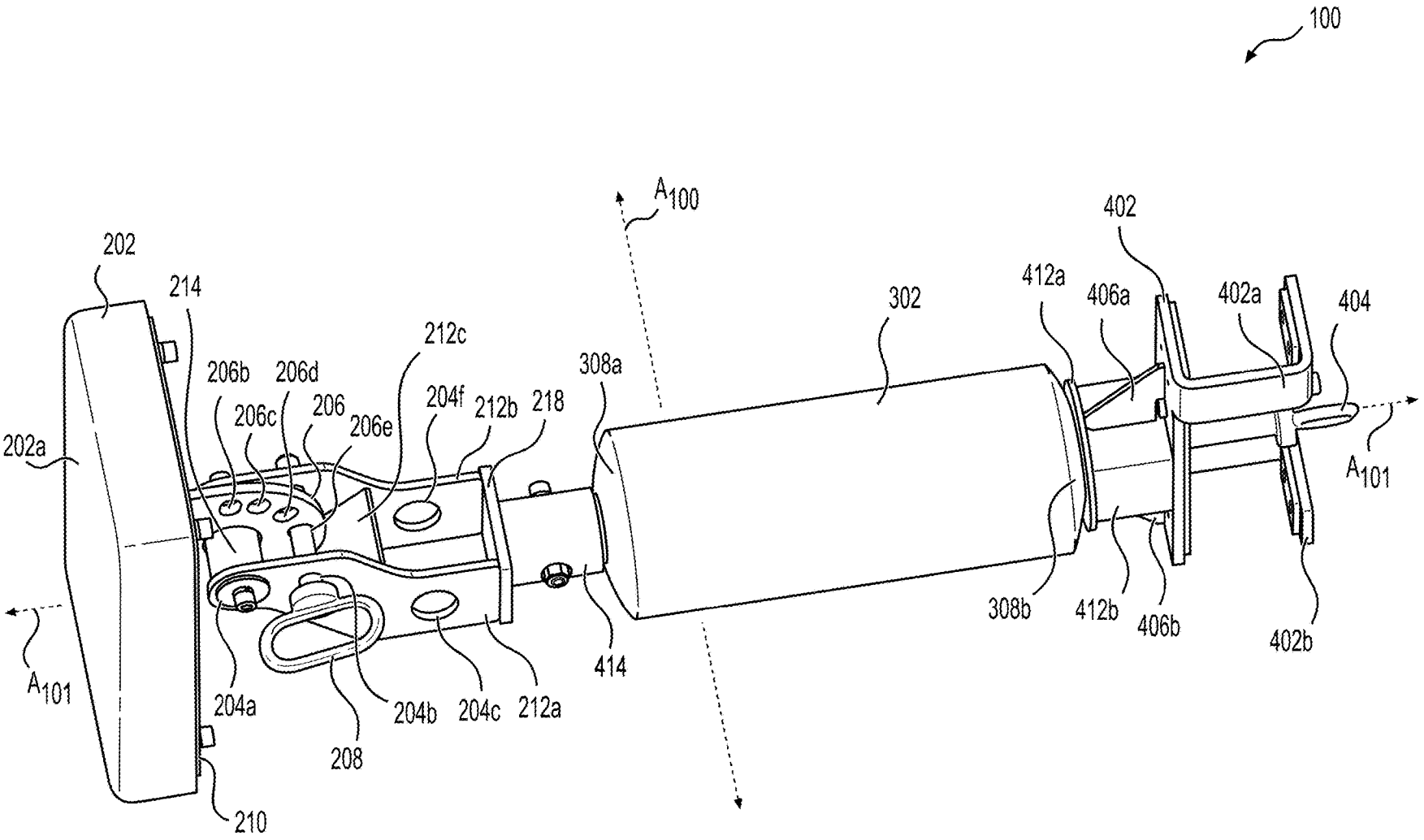
FIG. 3C is a perspective view of the consolidated weight-training apparatus of FIG. 1 with the chest pad in a third configuration, according to one or more embodiments.

Referring to FIG. 3A, a connection pin 214 extends through the first opening 204*a* of the first arm 212*a*, the first opening 206*a* of the connection joint 206, and the fourth opening 204*d* (not shown for illustrative purposes) of the second arm 212*b*. The connection pin 214 may be configured to couple the connection joint 206 of the chest support system 200 to the collar 204. With the chest pad 202 securely fixed to the connection joint 206, the connection pin 214 may be configured to couple the chest pad 202 and the collar 204 together when the chest support system 200 is fully assembled. The connection pin 214 is cylindrical in shape to allow the connection joint 206 to rotate about the connection pin 214 in a forward and/or rearward direction parallel to the longitudinal axis $A_{101}$ and perpendicular to the lateral axis $A_{100}$.

As shown in FIGS. 3A, 3B, and 3C, the chest support system 200 is configured to move (e.g., rotate, pivot, etc.) between a plurality of different positions relative to the collar 204. The chest support system 200 moves at a location that is away from the external equipment. Each position corresponds to a placement of the pin 208 through respective openings 206*b* 206*c*, 206*d*, and 206*e* of the connection joint 206. In other words, the pin 208 may be configured to maintain the chest support system 200 at one of the plurality of positions upon aligning with and extending through one of the openings 206*b* 206*c*, 206*d*, and 206*e*. The first position, shown in FIG. 3A, may correspond to the chest pad 202 being arranged in a flat orientation and/or 180 degree position relative to the collar 204. In the first position, the chest pad 202 is aligned in a parallel configuration with the longitudinal axis $A_{101}$. In the first position, the pin 208 is disposed through the second opening 204*b* of the first arm 212*a*, the second opening 206*b* of the connection joint 206, and the fifth opening 204*e* of the second arm 212*b*.

The second position, shown in FIG. 3B, may correspond to the chest pad 202 being arranged in an angled orientation and/or 45-degree position relative to the collar 204. In the second position, the chest pad 202 is aligned in a transverse configuration that intersects the longitudinal axis $A_{101}$ at about a 45-degree angle. In the second position, the pin 208 is disposed through the second opening 204*b* of the first arm 212*a*, the third opening 206*c* of the connection joint 206, and the fifth opening 204*e* of the second arm 212*b*. For illustration purposes only, the connection of the pin 208 with the first arm 212, the connection joint 206, and the second arm 212*b* is not shown in FIG. 3B.

The third position, shown in FIG. 3C, is the chest pad 202 in a parallel or 90-degree position. In the third position, the chest pad 202 is aligned in a transverse configuration that intersects the longitudinal axis $A_{101}$ at about a 90-degree angle such that the chest pad 202 is substantially perpendicular with the longitudinal axis $A_{101}$. In the third position, the pin 208 is disposed through the second opening 204*b* of the first arm 212*a*, the fifth opening 206*e* of the connection joint 206, and the fifth opening 204*e* of the second arm 212*b*.

It is contemplated that the connection joint 206 may include any number of openings for rotating the chest pad 202 through a plurality of positions relative to the collar 204. In some examples, the connection joint 206 may include six openings for rotating through a corresponding number of positions. In other examples, the connection joint 206 may include additional and/or fewer openings than those shown and described herein without departing from a scope of this disclosure. In some examples, the chest pad 202 may rotate, relative to the collar 204, in 10-degree increments. In other examples, the chest pad 202 may rotate, relative to the collar, in 15-degree increments, 30-degree increments, 45-degree increments, or other suitable degree intervals. In some examples, the chest pad 202 may be detachable from the weight-training apparatus 100 as shown in FIGS. 8A-8D.

Figure 4:
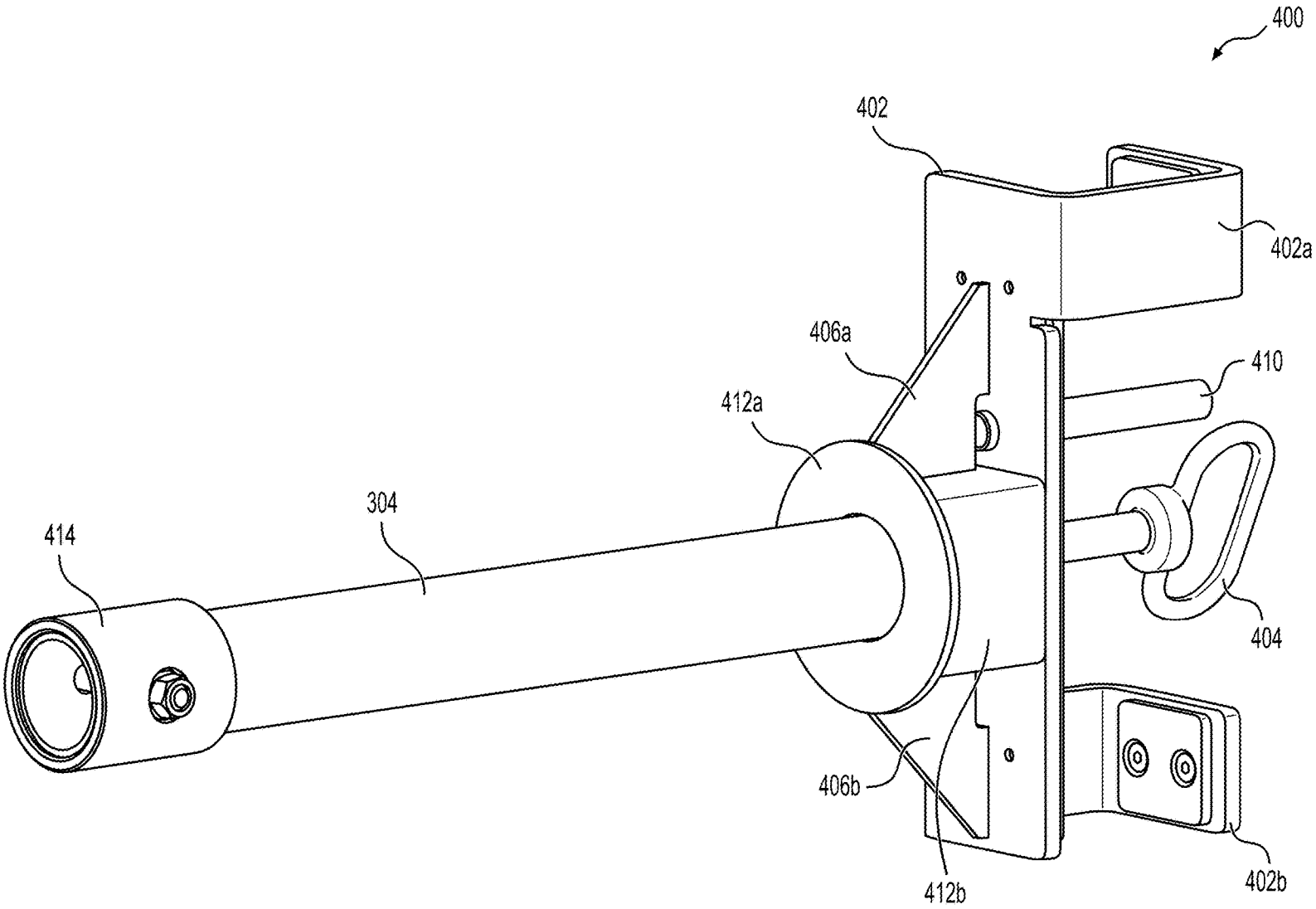
FIG. 4 is a perspective view of a mounting system of the consolidated weight-training apparatus of FIG. 1, according to one or more embodiments.

As shown in FIG. 4, the roller arm 304 extends from the mounting arm 402, through each of the first washer 412*a*, the bracket 412*b*, and the second washer 412*c* (not shown). The roller arm 304 extends from the mounting arm 402 to the joint 414. The joint 414 may be fixedly attached/coupled to the plate 218. The joint 414 is securely coupled to the roller arm 304 via a fastening mechanism (e.g., screws, bolts, etc.).

Figure 5A:
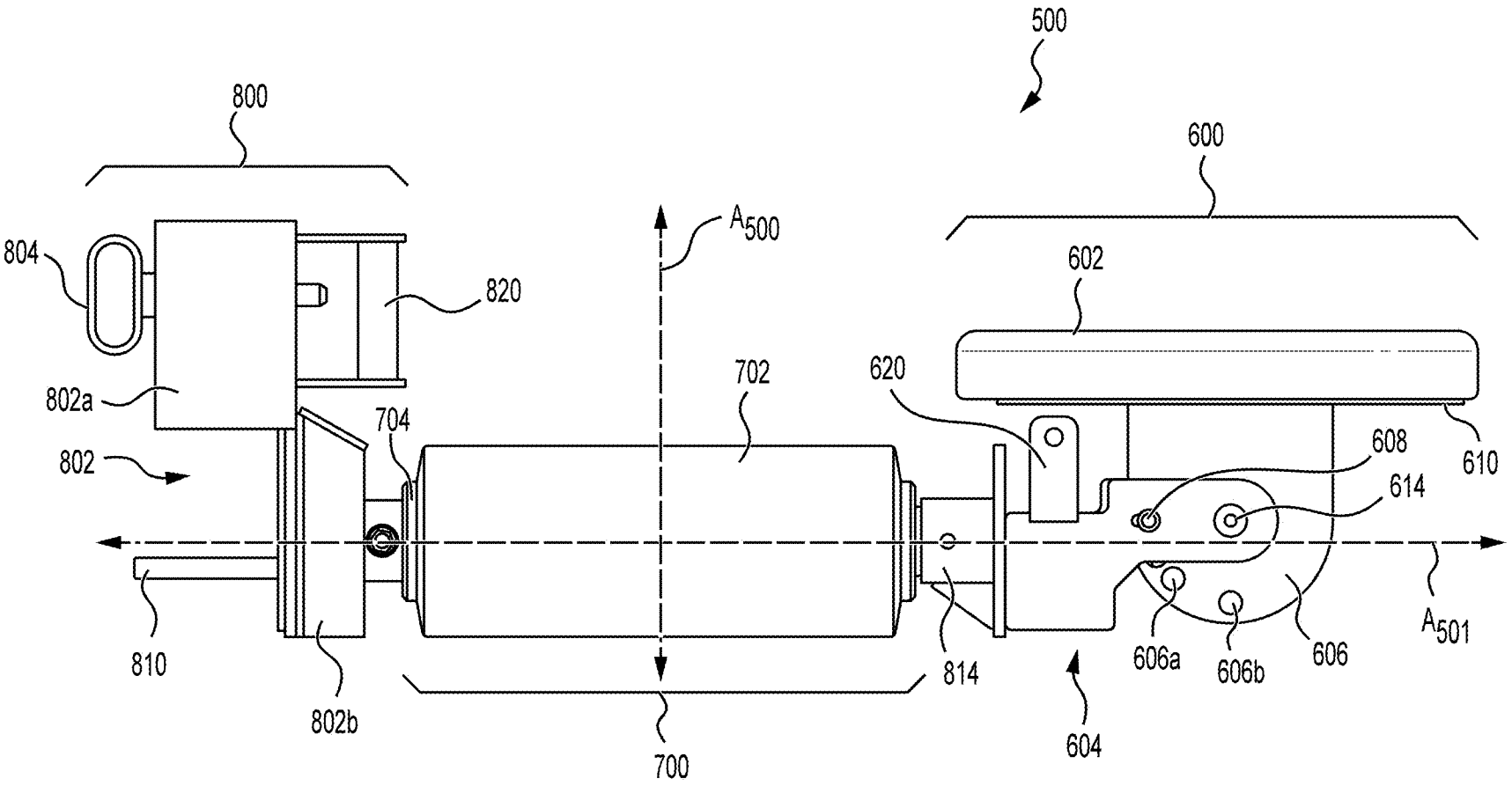
FIG. 5A is a side view of a consolidated weight-training apparatus, according to one or more embodiments.
Figure 5B:
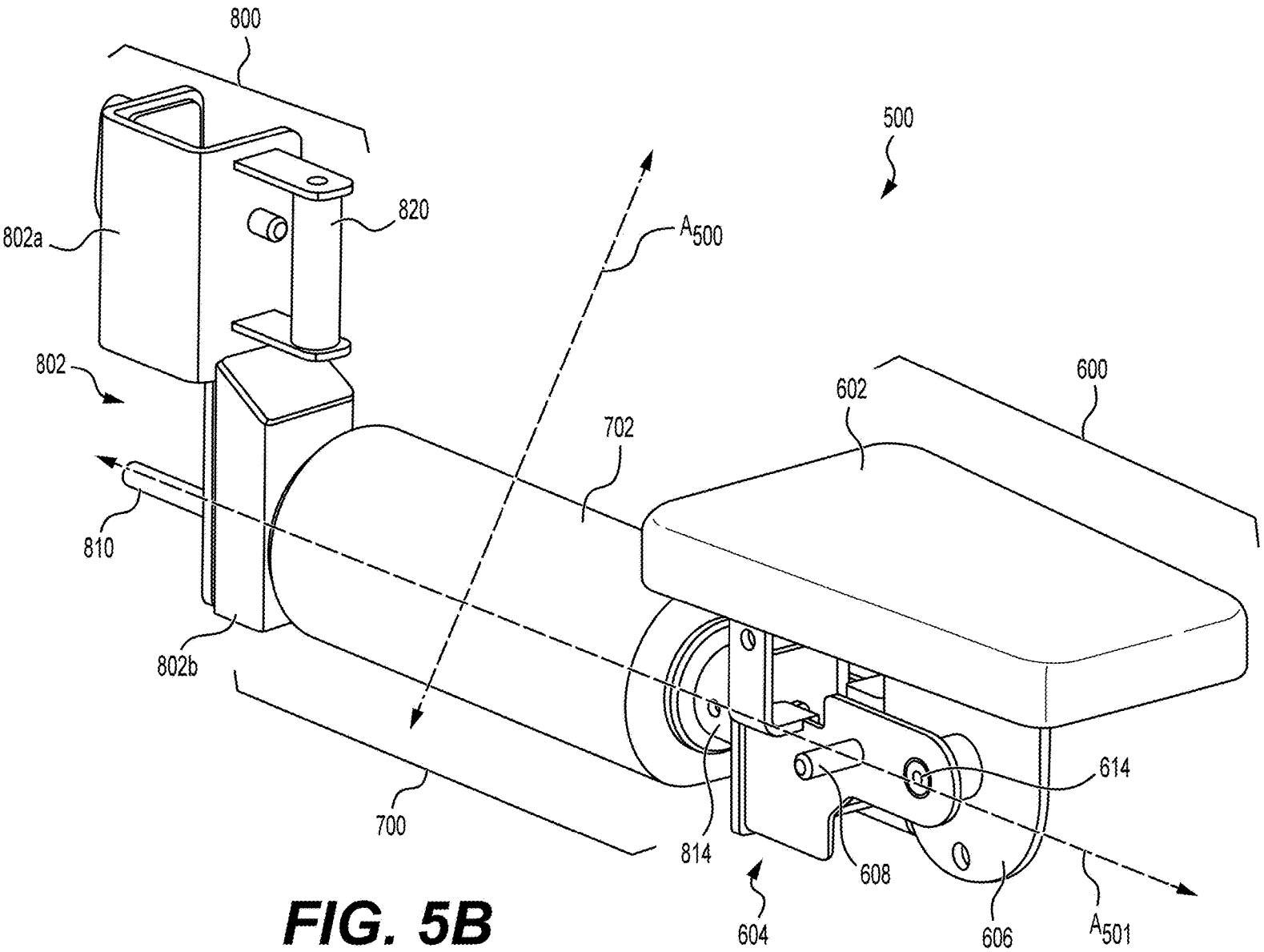
FIG. 5B is a perspective view of a consolidated weight-training apparatus, according to one or more embodiments.

A consolidated weight-training apparatus 500, shown in FIGS. 5A-5B, is similar to the consolidated weight-training apparatus 100. For example, the consolidated weight-training apparatus 500 includes a chest support system 600, a roller system 700, and a mounting system 800. For brevity, the consolidated weight-training apparatus 500 and the consolidated weight-training apparatus 100 may contain many similar components; the functions of these similar components previously discussed with respect to the consolidated weight-training apparatus 100 will not be discussed with respect to the consolidated weight-training apparatus 500. A lateral axis $A_{500}$ extends laterally through the consolidated weight-training apparatus 500. A longitudinal axis $A_{501}$ extends longitudinally through the consolidated weight-training apparatus 500 transversely (e.g., perpendicular) to the lateral axis $A_{500}$.

The chest support system 600, like the chest support system 200, includes a chest pad 602, a collar 604, a connection joint 606 with one or more openings (e.g., an opening 606*a* and an opening 606*b*), a pin 608, a plate 610, and a connection pin 614. The chest support system 600 also includes a first handle 620. The length of the first handle 620 extends perpendicularly to the lateral axis $A_{500}$ and the longitudinal axis $A_{501}$. The roller system 700, like the roller system 300, includes a roller 702 and a roller arm 704. A joint 814 connects the chest support system 600 to the roller system 700. The mounting system 800 includes a mounting arm 802, a bracket 802*a*, a support brace 802*b*, a pin 804, a support pin 810, and a second handle 820. The second handle 820 may extend away from bracket 802*a* such that the length of the second handle 820 is parallel to the lateral axis $A_{500}$.

A user may use the first handle 620 and/or the second handle 820 to facilitate moving the consolidated weight-training apparatus 500. For example, when connecting the consolidated weight-training apparatus 500 to external equipment, the user can use the first handle 620 and/or the second handle 820 to safely secure the support pin 810 to the external equipment. The first handle 620 and the second handle 820 make maneuvering the consolidated weight-training apparatus 500 easier as the user can securely pick up the consolidated weight-training apparatus 500.

The consolidated weight-training apparatus 500 only has one bracket (e.g., bracket 802*a*) which makes securing the consolidated weight-training apparatus 500 to external equipment (e.g., an upright of a power rack) easier without making the cantilever connection less secured. Similar to the consolidated weight-training apparatus 100, the consolidated weight-training apparatus 500 may be turned to feed the support pin 810 through a through hole of the upright and turned back to the initial orientation to feed the pin 804 through a different through hole of the upright. Thus, when in the correct, secured orientation, the bracket 802*a* cups and/or contacts the upright. The bracket 802*a*, the pin 804, and the support pin 810 together secure the consolidated weight-training apparatus 500 to external equipment. The support pin 810 is fixedly attached to and extends away from the 802*bb*//, while the pin 804 is removeable. The support brace 802*b* provides a rigid structure for support pin 810 to be attached to and reduces the torque applied to the consolidated weight-training apparatus 500 when the consolidated weight-training apparatus 500 is suspended.

Figure 6A:
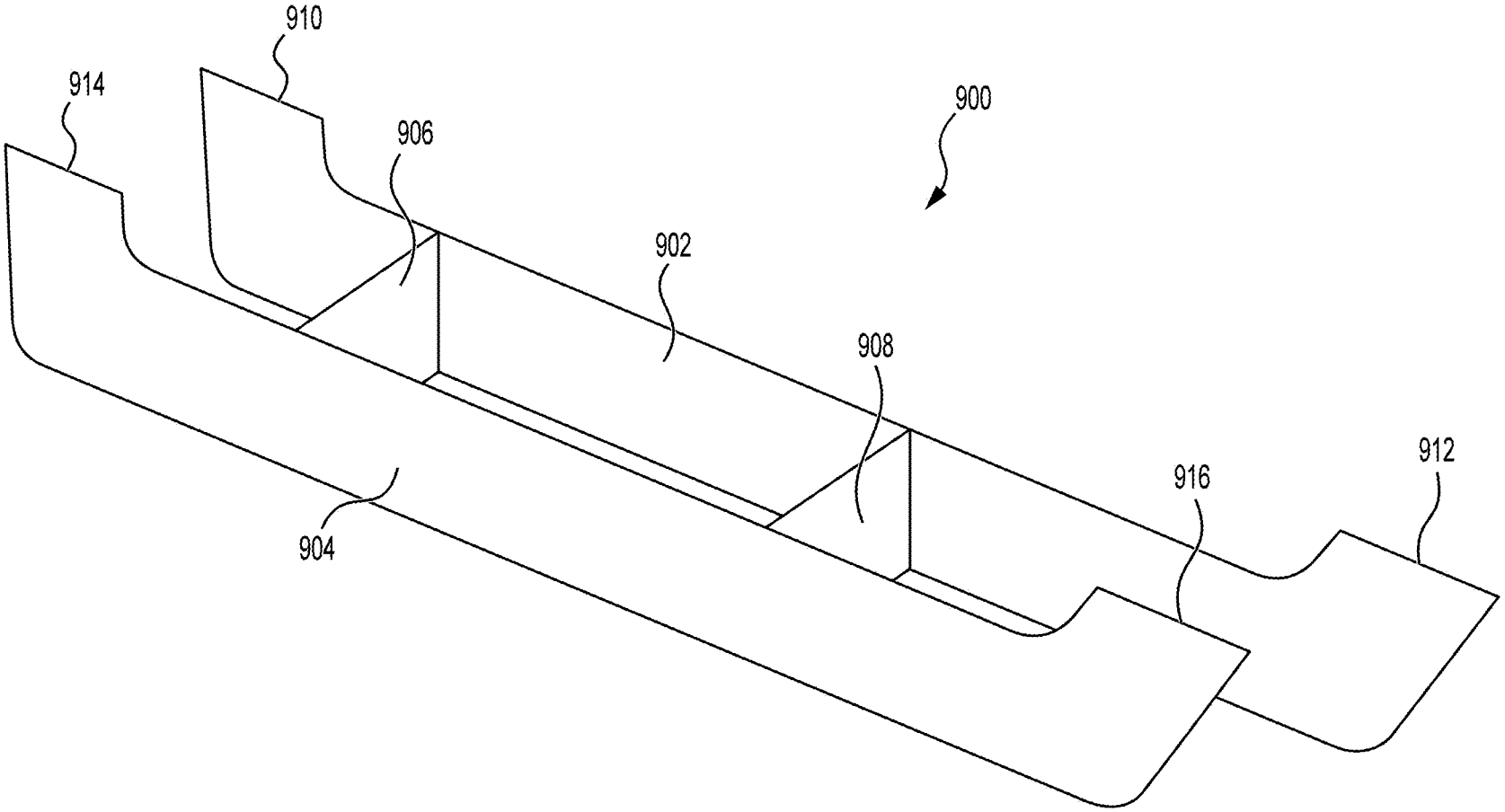
FIG. 6A is a perspective view of a support frame, according to one or more embodiments.
Figure 6B:
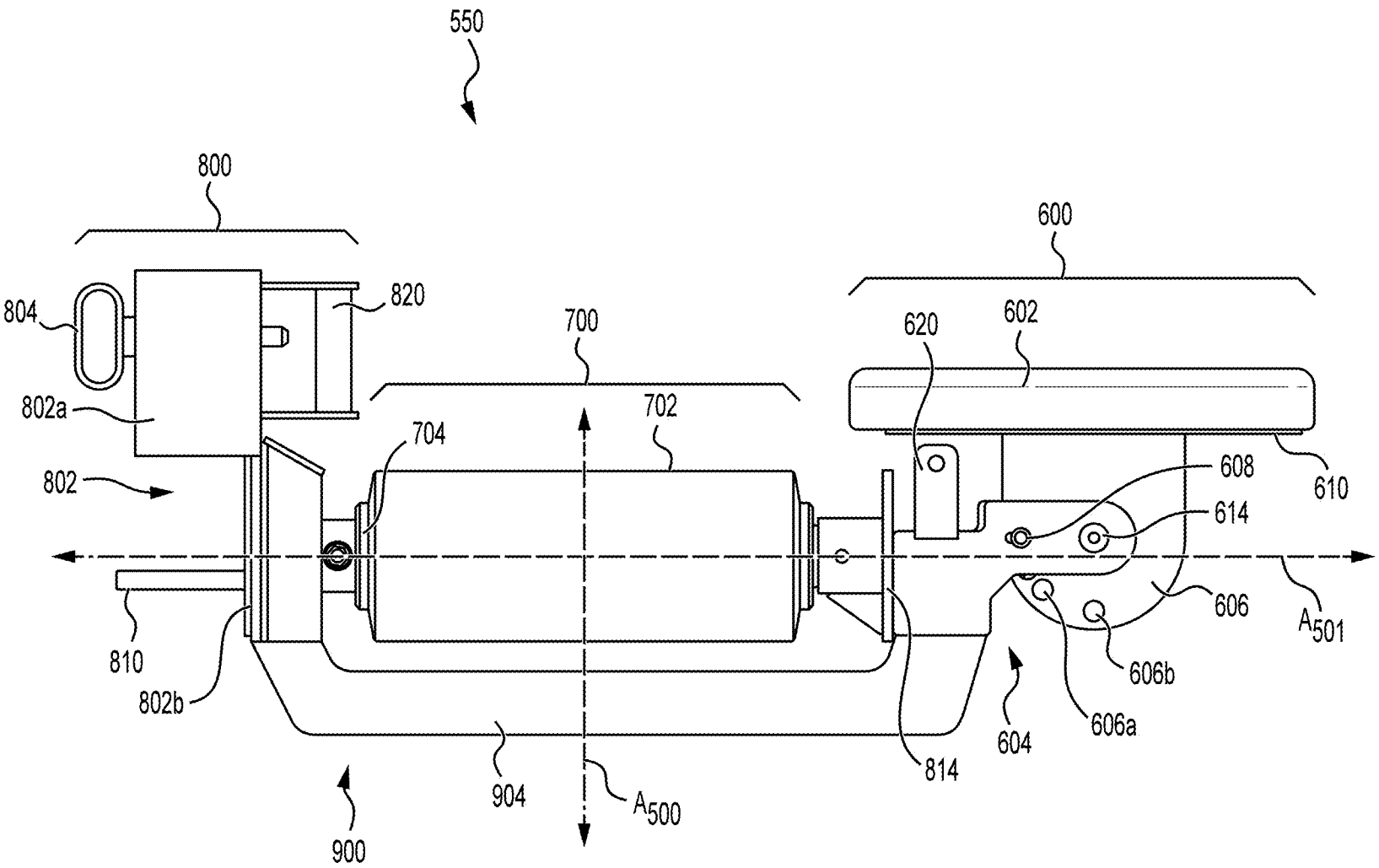
FIG. 6B is a side view of a consolidated weight-training apparatus with the support frame of FIG. 6A, according to one or more embodiments.
Figure 6C:
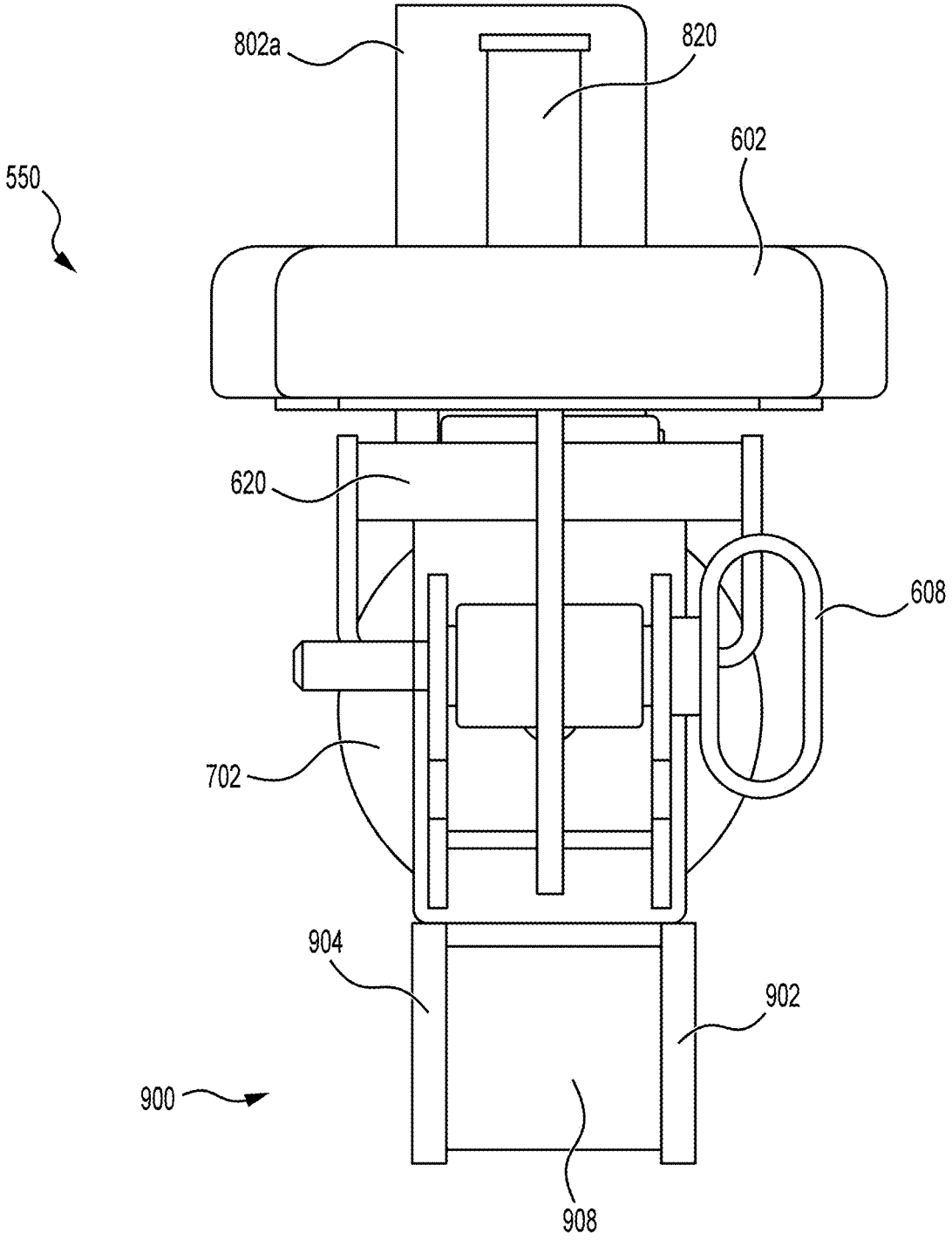
FIG. 6C is a front view of the consolidated weight-training apparatus of FIG. 6B, according to one or more embodiments.
Figure 6D:
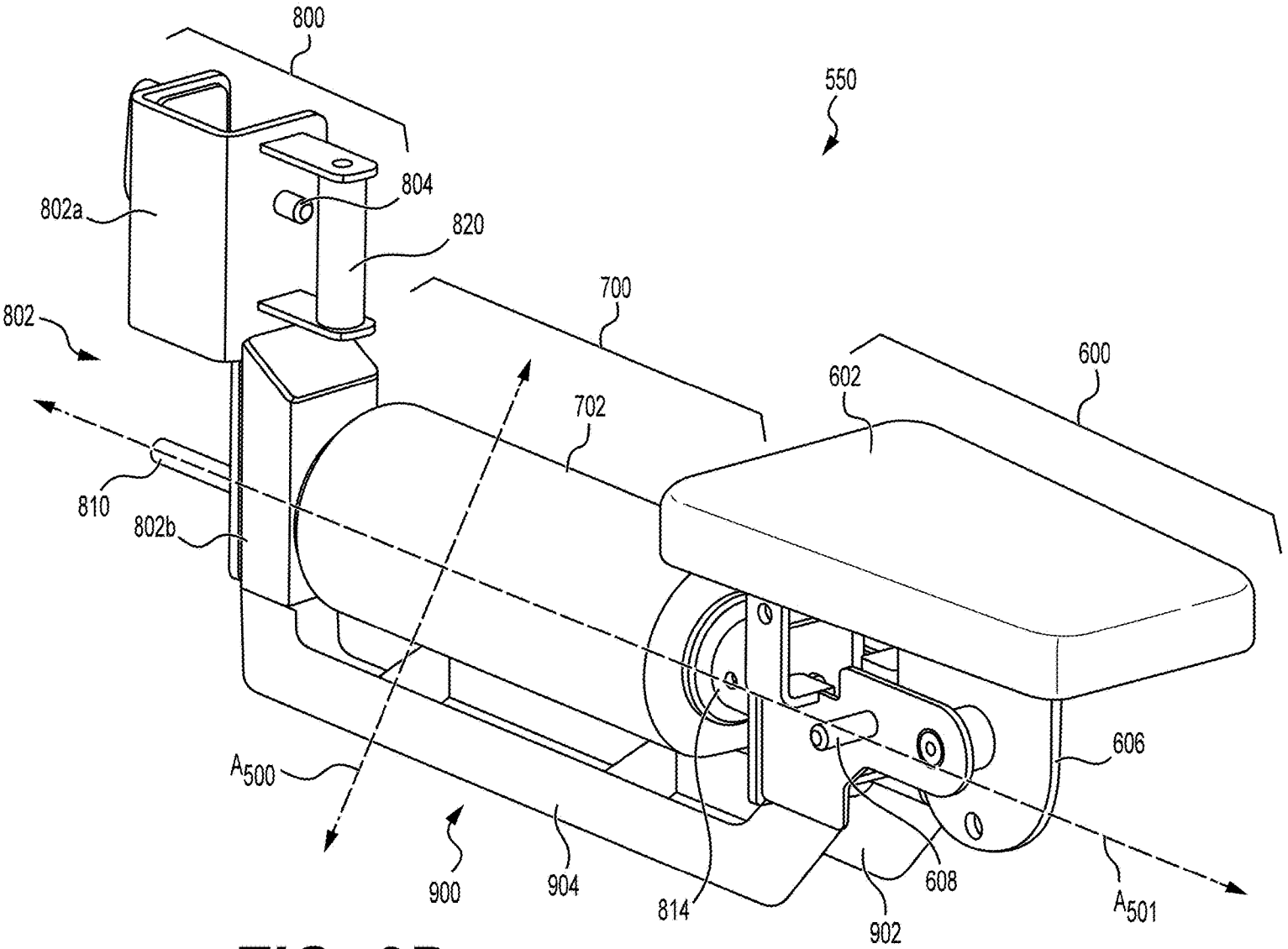
FIG. 6D is a perspective view of the consolidated weight-training apparatus of FIG. 6B, according to one or more embodiments.

A support frame 900, as shown in FIG. 6A, can be attached to or formed with a consolidated weight-training apparatus 550, as shown in FIGS. 6B-E. In some examples, the consolidated weight-training apparatus 100 and/or the consolidated weight-training apparatus 500 include the support frame 900. The consolidated weight-training apparatus 500 may be substantially similar to the consolidated weight-training apparatus 500 with the addition of the support frame 900.

Referring to FIG. 6A, the support frame 900 includes a first arm 902 with a first end 910 and a second end 912, a second arm 904 with a first end 914 and a second end 916, a first support brace 906, and a second support brace 908. The first support brace 906 and the second support brace 908 connect the first arm 902 and the second arm 904 to each other. The first arm 902 and the second arm 904 are the same size and shape, and extend parallel to each other. Similarly, the first support brace 906 and the second support brace 908 are the same size and shape, and extend parallel to each other. In some examples, the first arm 902 and the second arm 904 extend perpendicular to the first support brace 906 and the second support brace 908. In an example, the support frame 900 includes more than two support braces. In an example, the support frame 900 includes only one support brace. In the example shown in FIG. 6A, the first support brace 906 is closer to the first end 910 and the first end 914 than the second end 912 and the second end 916 while the second support brace 908 is closer to the second end 912 and the second end 916 than the first end 910 and the first end 914.

The support frame 900 increases the strength and the rigidity of the consolidated weight-training apparatus 550. For example, since the consolidated weight-training apparatus 550 is a cantilever connected at the mounting system 800 end, when loading the opposite end at the chest pad 602, a bending moment (e.g., torque) is applied to the consolidated weight-training apparatus 550. With high weights, this torque can be significant and can cause structural damage and/or failure. The support frame 900 reduces the torque (e.g., bending force) applied to the consolidated weight-training apparatus 550. The support frame 900, as can be best seen in FIG. 6B, extends longitudinally along the longitudinal axis $A_{500}$ below the roller system 700. The first end 910 and the first end 914 are attached to or formed with the support brace 802*b* and the second end 912 and the second end 916 are attached to or formed with the collar 604. The first arm 902 and the second arm 904 extend parallel to the roller 702. Thus, the mounting system 800 is connected to the chest support system 600 via the support frame 900 in addition to the roller system 700.

Figure 6E:
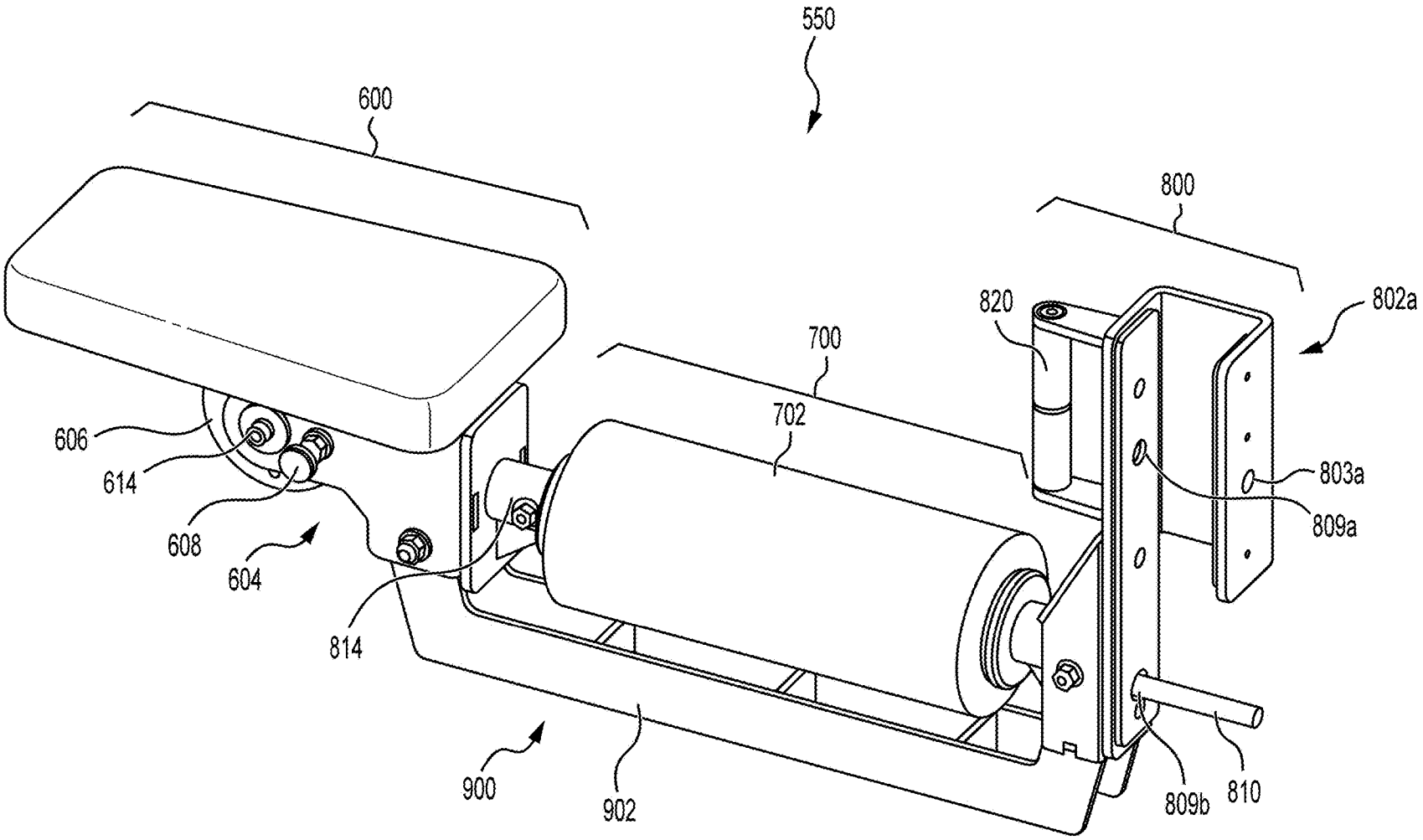
FIG. 6E is a perspective view of a consolidated weight-training apparatus with the support frame of FIG. 6A, according to one or more embodiments.

Referring to FIG. 6E, the mounting system 800 of the consolidated weight-training apparatus 550 includes a first opening 803*a*, a second opening 809*a*, and a third opening 809*b*. The support pin 810 extends through and from third opening 809*b*, while the pin 804 extends through both the first opening 803*a* and the second opening 809*a*. Specifically, when the consolidated weight-training apparatus 550 is attached to an upright of a power rack, the upright extends between first opening 803*a* and second opening 809*a*. Support pin 810 and pin 804 are spaced apart such that, when the support pin 810 is received by a through hole of the upright, a different through hole of the upright aligns with first opening 803*a* and second opening 809*a* so the pin 804 can extend through both the bracket 802*a* (via the first opening 803*a* and the second opening 809*a*) and the upright to secure the consolidated weight-training apparatus 550 in place.

Figure 7:
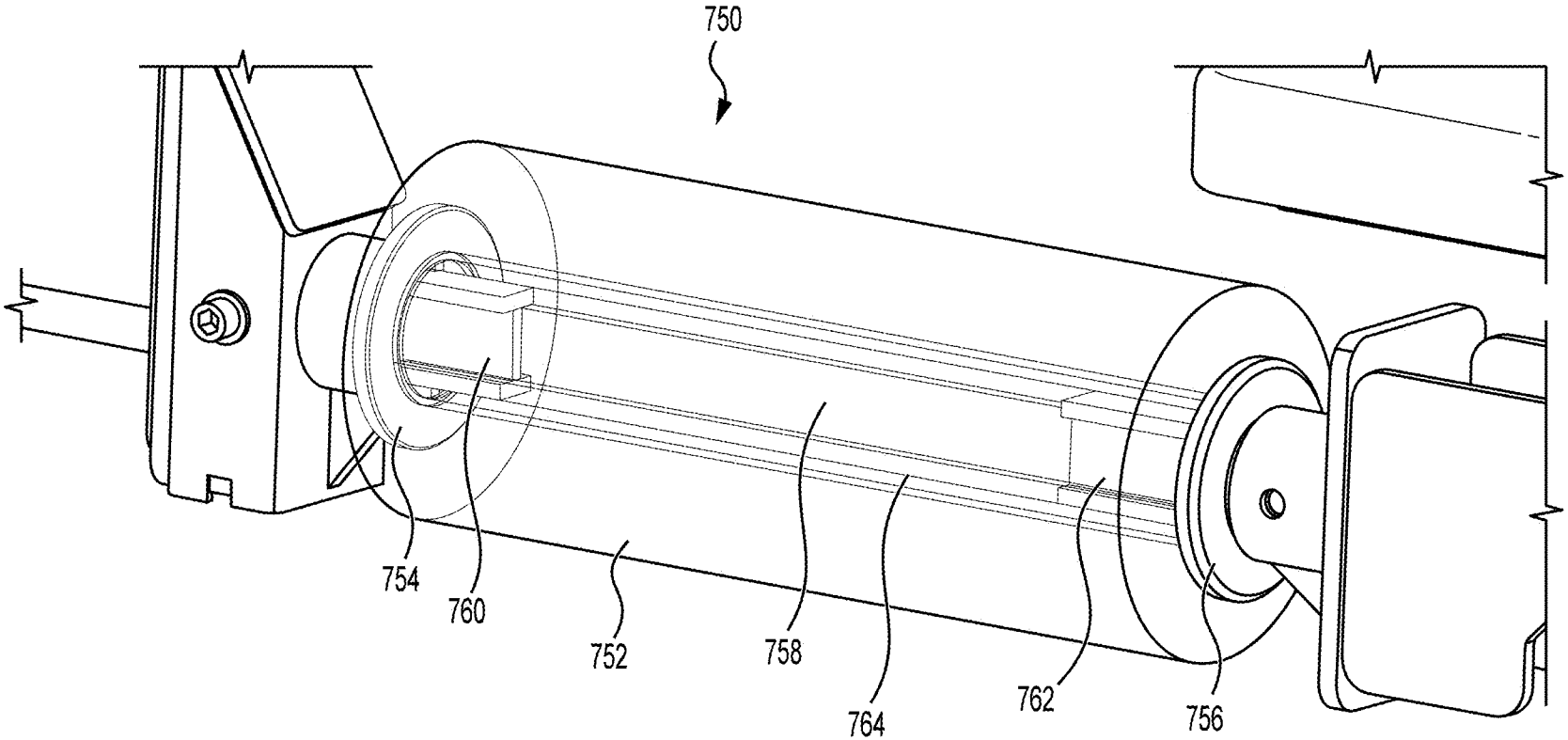
FIG. 7 is a perspective view of a roller system, according to one or more embodiments.
Figure 8A:
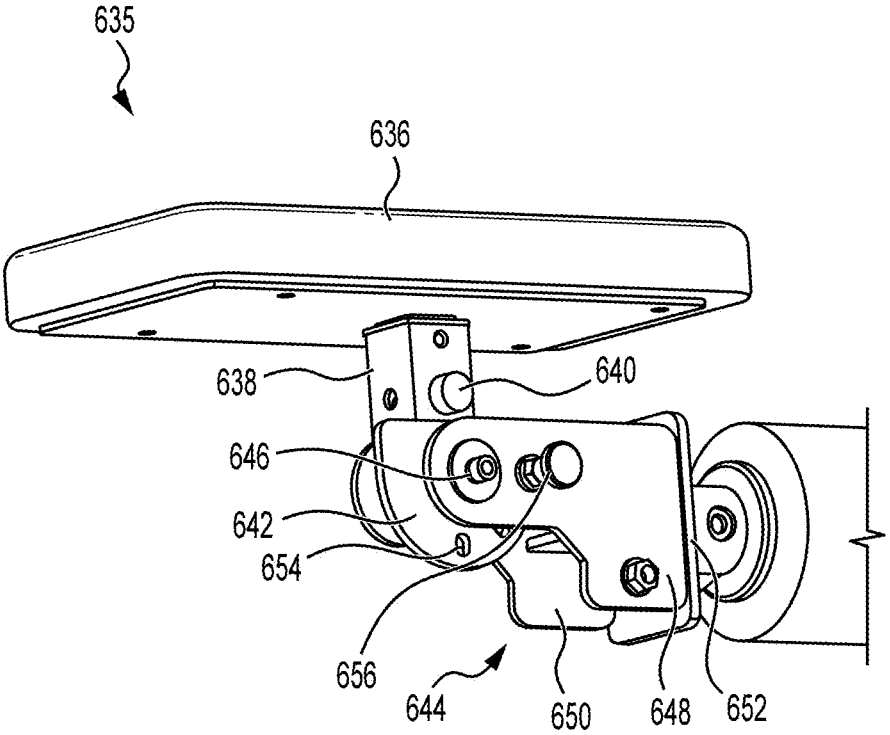
FIG. 8A is a perspective view of a chest support system, according to one or more embodiments.
Figure 8B:
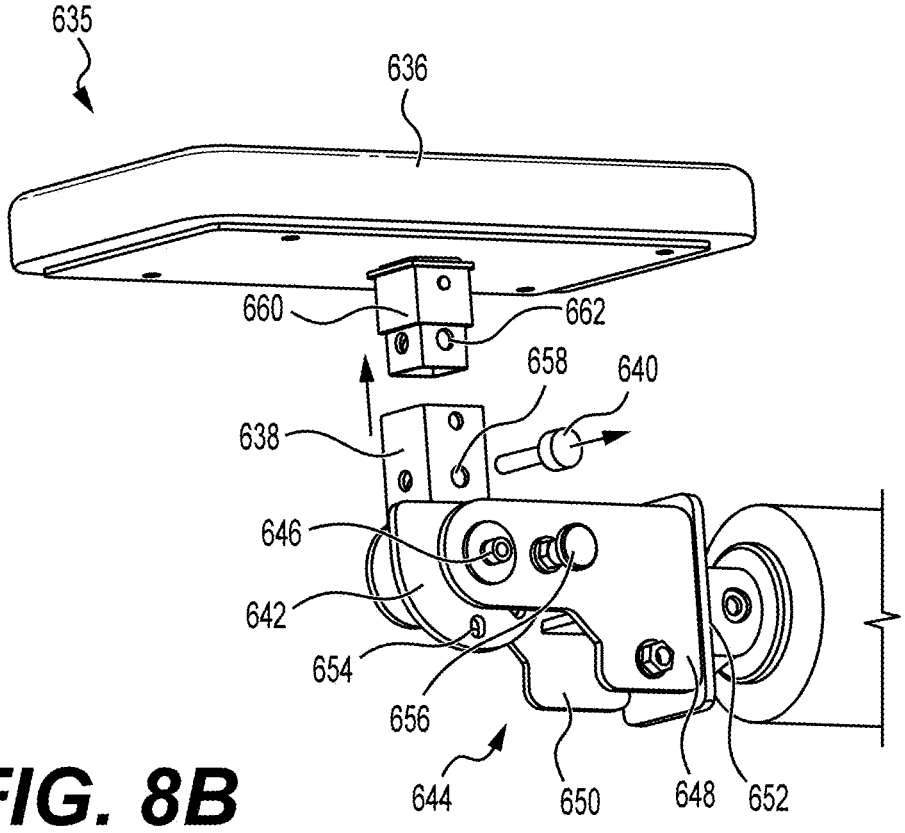
FIG. 8B is a perspective view of the chest support system of FIG. 8A taken apart, according to one or more embodiments.
Figure 8C:
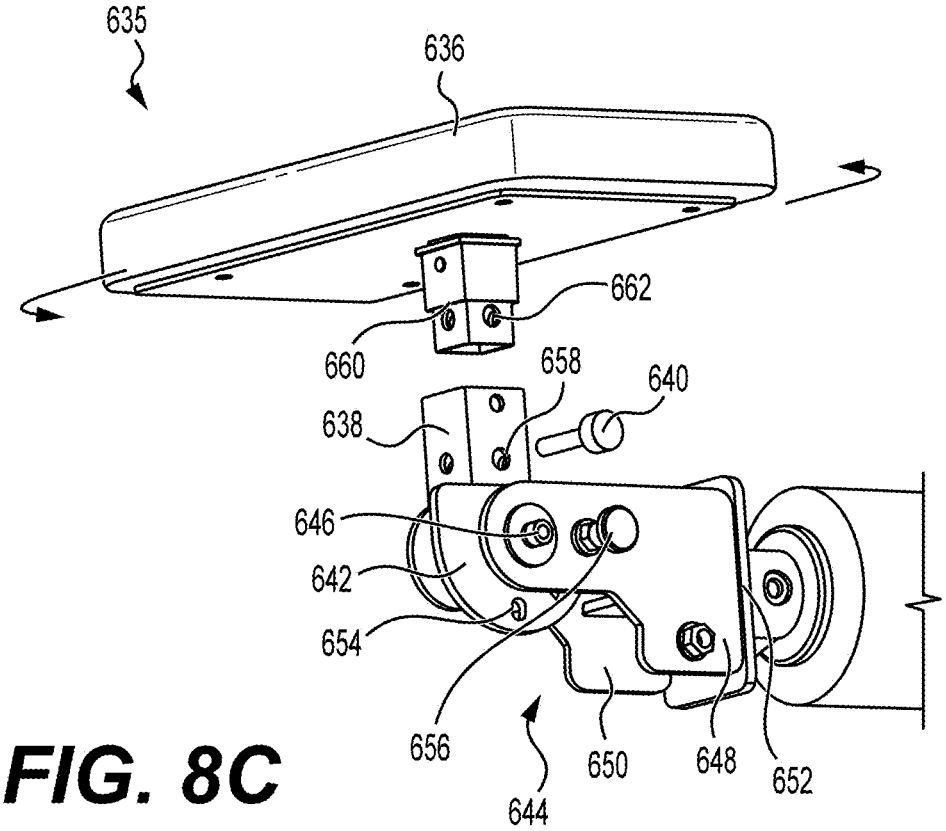
FIG. 8C is a perspective view of the chest support system of FIG. 8A taken apart with a chest pad rotated, according to one or more embodiments.
Figure 8D:
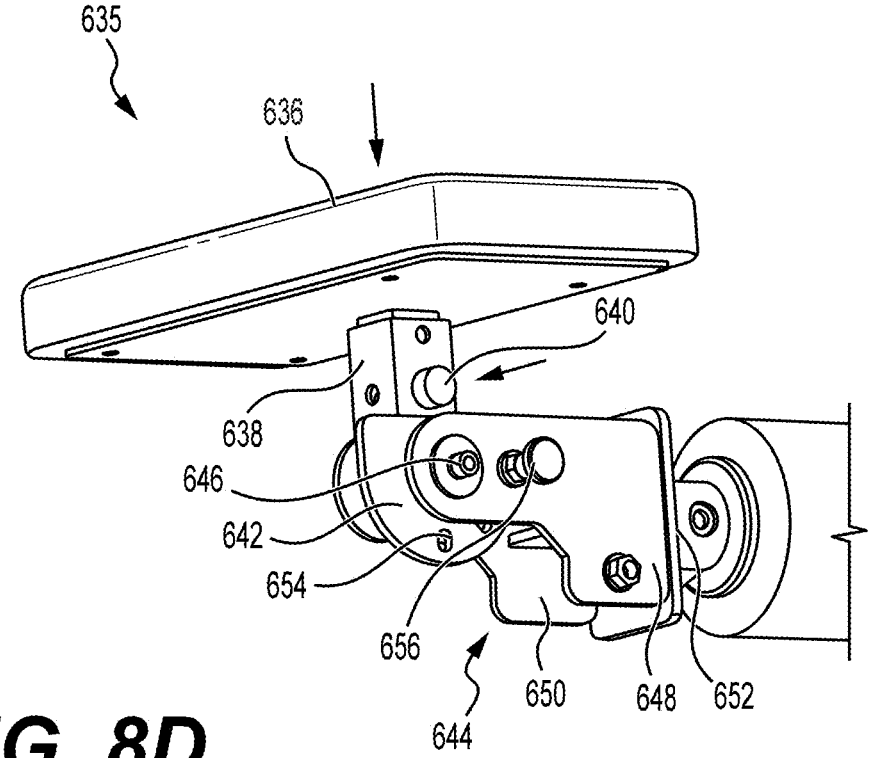
FIG. 8D is a perspective view of the chest support system of FIG. 8A with the chest pad rotated, according to one or more embodiments.

FIG. 7 shows a roller system 750. Roller system 750 can be used with any of the weight-training apparatuses described herein, such as the consolidated weight-training apparatus 100, the consolidated weight-training apparatus 500, and/or the consolidated weight-training apparatus 550. Roller system 750 is similar to the roller system 300 or the roller system 700. Roller system 750 includes a roller 752, a first end 754, a second end 756, a lumen 758, a first I-beam 760, a second I-beam 762, and a roller arm 764 that defines a volume of the lumen 758. The first I-beam 760 extends into the lumen 758 at the first end 754 and the second I-beam 762 extends into the lumen 758 at the second end 756. In this way, there is a gap between the first I-beam 760 and the second I-beam 762. The first I-beam 760 extends only partially into the lumen 758 such that the first I-beam 760 terminates closer to the first end 754 than a center of the lumen 758. Similarly, the second I-beam 762 extends only partially into the lumen 758 such that the second I-beam 762 terminates closer to the second end 756 than the center of the lumen 758. In some examples, the first I-beam 760 and the second I-beam 762 terminate closer to the center of the lumen 758 than the respective ends. In an example, instead of having the first I-beam 760 and the second I-beam 762, one I-beam continuously extends through lumen 758 from the first end 754 to the second end 756. The first I-beam 760 and the second I-beam 762, in some examples, may generally be support beams instead of specifically I-beams.

FIGS. 8A-8D show a chest support system 635 that is removably attached to the rest of a consolidated weight-training apparatus. Chest support system 635 is similar to chest support system 200 and/or chest support system 600. Chest support system 635 includes a chest pad 636, a hollow support tube 638, a locking pin 640, a connection joint 642, a collar 644, a connection pin 646, one or more openings 654, a pin 656, a first pin opening 658, a support base 660, and a second pin opening 662. The collar 644 includes a first arm 648, a second arm 650, and a plate 652. In some examples, the pin 656 is removably attached to the chest support system 635. In some examples, the pin 656 is a spring pin such that, when force is applied, the pin 656 is pulled out of the one or more openings 654 but stays fixedly attached to the chest support system 635.

The support base 660 is fixedly attached to the chest pad 636 and removably attached to the hollow support tube 638. Specifically, the locking pin 640 is fed through the first pin opening 658 and the opening 662 to attach the support base 660 to the hollow support tube 638 and the locking pin 640 is removed from the first pin opening 658 and the opening 662 to remove the chest pad 636 from the rest of the chest support system 635. As demonstrated in FIGS. 8A-D, the locking pin 640 can be removed to rotate the chest pad 636. The chest pad 636 is lifted away from the hollow support tube 638, rotated, and then lowered back down such that the hollow support tube 638 receives a portion of the support base 660. The chest pad 636 rotates in 90-degree increments (since the support base 660 and the hollow support tube 638 are rectangular) and is locked in place via the locking pin 640. In some examples, the support base 660 and the hollow support tube 638 are non-rectangular to allow the chest pad 636 to rotate in various degree increments.

Figure 9A:
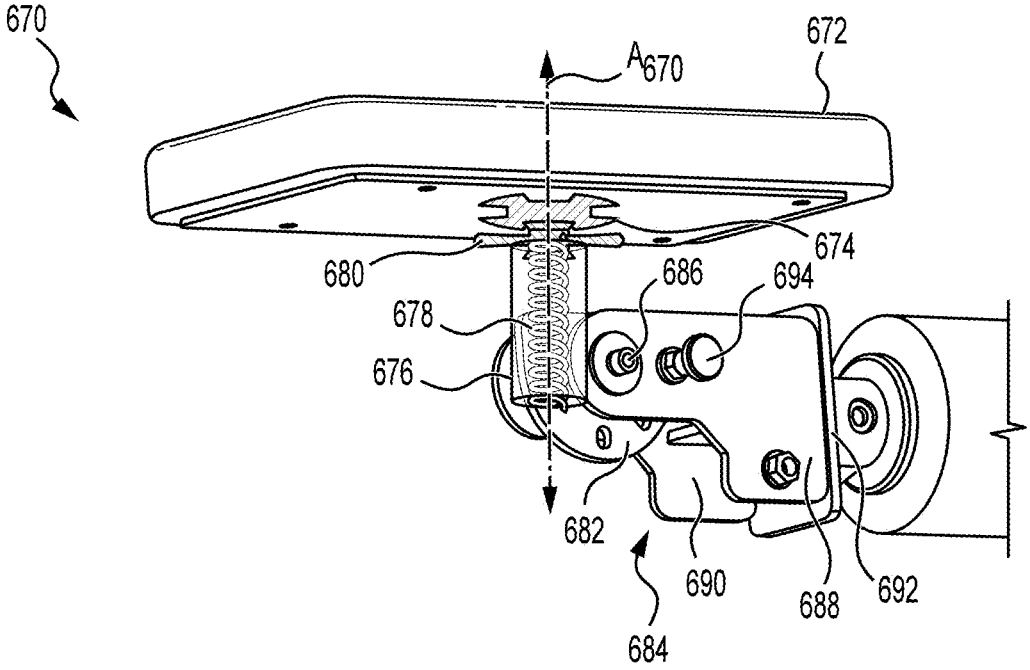
FIG. 9A is a perspective view of a chest support system with a spring, according to one or more embodiments.
Figure 9B:
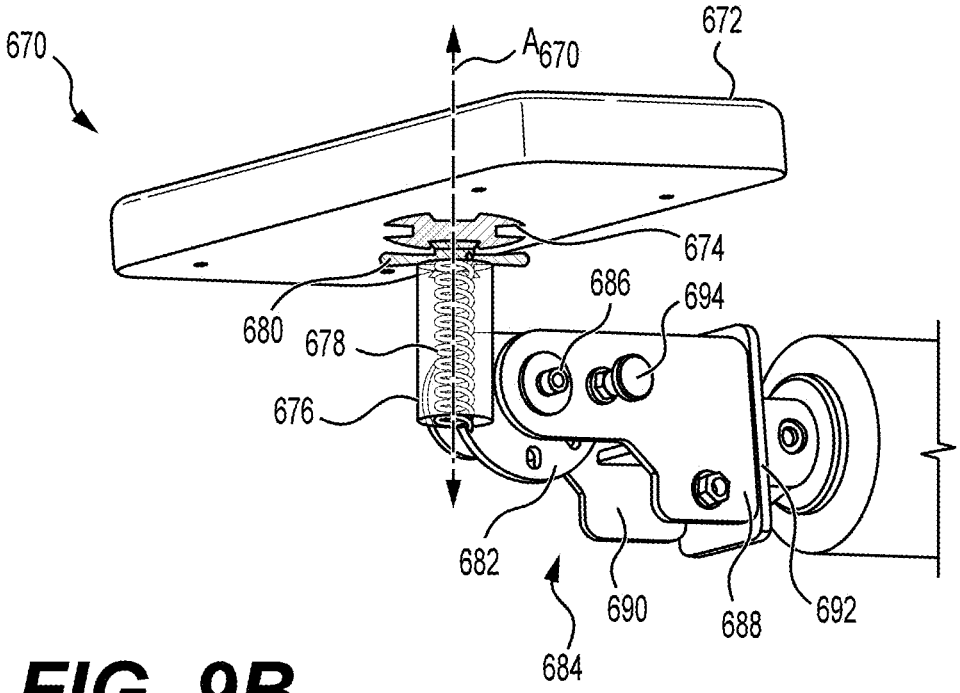
FIG. 9B is a perspective view of the chest support system of FIG. 9A with a chest pad rotated, according to one or more embodiments.

FIGS. 9A and 9B show a chest support system 670 that also enables a chest pad 672 to rotate, similar to the chest support system 635. However, the chest pad 672 is not removably attached to the rest of the chest support system 670, but rather fixedly attached. The chest support system 670 includes the chest pad 672, a locking wheel 674, a hollow support tube 676, a spring 678, a locking plate 680, a connection joint 682, a collar 684, a connection pin 686, and a pin 694. The collar 684 includes a first arm 688, a second arm 690, and a plate 692. The chest pad 672 is configured to rotate about a longitudinal axis $A_{670}$ in 90-degree increments. The chest pad 672 is connected to the spring 678, which biases the chest pad 672 to stay in contact with the hollow support tube 676. The hollow support tube 676 can be considered a spring-loaded tube. For example, the spring 678 allows the chest pad 672 to disengage from the hollow support tube 676 but stay connected to the chest support system 670 when a user pulls up on the chest pad 672 away from the hollow support tube 676. When the chest pad 672 is released, the chest pad 672 reengages and contacts the hollow support tube 676. Specifically, the chest pad 672 and the hollow support tube 676 interface (e.g., contact each other) via the locking wheel 674 and the locking plate 680.

Figure 9C:
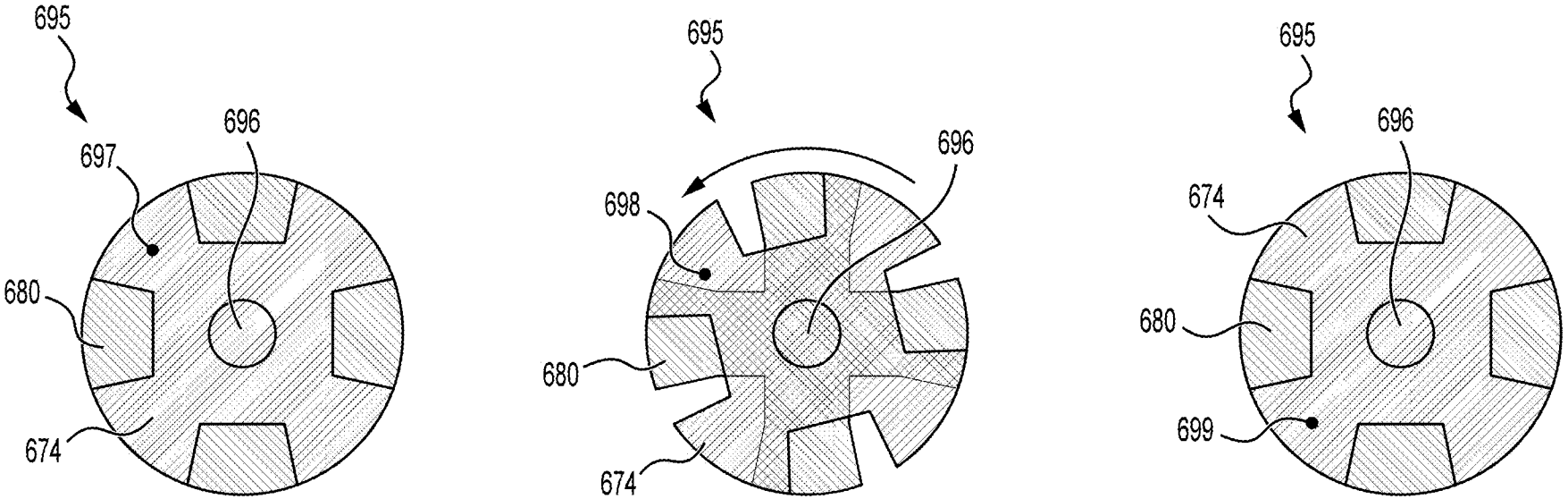
FIG. 9C is a top view of a rotary locking system used with the chest support system of FIG. 9A.

The locking wheel 674 is fixedly attached to the chest pad 672 and the locking plate 680 is fixedly attached to the hollow support tube 676. The locking wheel 674 and the locking plate 680 are removably coupled to each other. The spring 678 extends through the locking plate 680 and is connected to the locking wheel 674. Referring to FIG. 9C, the locking wheel 674 and the locking plate 680 create a rotary locking system 695. When in the locked position, the locking wheel 674 rests on top of the locking plate 680 and the locking wheel 674 and the locking plate 680 are flush with each other. The notches of the locking plate 680 (e.g., the portions of the locking plate 680 that do not overlap with the locking wheel 674 when in the locked position) extend in the longitudinal direction towards the chest pad 672 such that the sides of the locking wheel 674 contact the sides of the notches of the locking plate 680. In an example, a top surface of the notches of the locking plate 680 is flush with a top surface of the locking wheel 674. In some examples, the notches of the locking plate 680 extend past the locking wheel 674.

The rotary locking system 695 ensures the chest pad 672 and the hollow support tube 676 stay coupled unless there is sufficient force in the longitudinal direction applied to the chest pad 672 to pull the chest pad 672 away from the hollow support tube 676. The shape of the locking wheel 674 and the locking plate 680, and the fact that the notches of locking plate 680 protrude to contact the side walls of the locking wheel 674, restrict rotational movement about the longitudinal axis $A_{670}$ while the locking wheel 674 and the locking plate 680 are engaged with each other. An opening 696 in the locking plate 680 facilitates the connection between the spring 678 and the locking wheel 674. That is, the spring 678 extends through the opening 696 to couple with the locking wheel 674.

In an example, the locking wheel 674 (and consequently the chest pad 672) is in a first position 697. When in the first position 697, the chest pad 672 is secured to the hollow support tube 676 rotationally about the longitudinal axis $A_{670}$ since the notches of the locking plate 680 are within the gaps of the locking wheel 674. A user then applies a force to the chest pad 672 to pull the chest pad 672 away from the hollow support tube 676. The spring 678 allows for the chest pad 672 to move far enough away from the hollow support tube 676 so the locking wheel 674 is lifted above the notches and rotated above the locking plate 680. Thus, the locking wheel 674 is in a second position 698 where the locking wheel 674 is not engaged with the locking plate 680 and in an unlocked position (e.g., rotational movement of the locking wheel 674 and the chest pad 672 is not restricted). The user rotates the chest pad 672 90 degrees and the locking wheel 674 reengages with the locking plate 680 (e.g., the notches of the locking plate 680 are back in the gaps of the locking wheel 674) to restrict any further rotational movement. The locking wheel 674 is now in a third position 699 that is rotated 90 degrees from the first position 697. The user can continue to change the orientation of the chest pad 672 by cycling through the locked positions of the rotary locking system 695.

In some examples, the chest pad 202, the chest pad 602, the chest pad 636, and/or the chest pad 672 are comprised of a foamed material that may be at least partially deformable upon an application of force thereto, such as upon receipt of a user's body or portion thereof (e.g., a chest). The chest pad 202, the chest pad 602, the chest pad 636, and/or the chest pad 672 may be comprised of Polyurethane (PU) foam, spray foam, melamine foam, or any other foamed material suitable for a desired amount of cushioning. In some examples, the roller 302, the roller 702, and/or the roller 752 are comprised of a foamed material that may be at least partially deformable upon an application of force thereto, such as upon receipt of a user's body or portion thereof (e.g., a leg). The roller 302, the roller 702, and/or the roller 752 may be comprised of Polyurethane (PU) foam, spray foam, melamine foam, or any other foamed material suitable for a desired amount of cushioning. In some examples, other portions of the consolidated weight-training apparatus 100 apart from the chest pad 202 and the roller 302, other portions of the consolidated weight-training apparatus 500 apart from the chest pad 602 and the roller 702, and/or other portions of the consolidated weight-training apparatus 550 apart from the chest pad 602 and the roller 702 are comprised of a substantially rigid material thus reducing and minimizing flexion of the consolidated weight-training apparatus 100, the consolidated weight-training apparatus 500, or the consolidated weight-training apparatus 550. These portions of the consolidated weight-training apparatus 100, the consolidated weight-training apparatus 500, and/or the consolidated weight-training apparatus 550 may be comprised of heavy-duty steel, anodized steel, or any other substantially rigid material suitable for holding the weight of a person. The consolidated weight-training apparatus 100, the consolidated weight-training apparatus 500, and/or the consolidated weight-training apparatus 550 may have a maximum weight of about 1000 lbs (454 kg).

The consolidated weight-training apparatus 100, the consolidated weight-training apparatus 500, and/or the consolidated weight-training apparatus 550 allows a user or multiple users to efficiently perform weighted exercises without the need to use separate equipment or to move away to different areas of a surrounding environment unnecessarily to access the separate equipment. The shape, size, and/or configuration of the collar 204 and/or the collar 604 improves the weight bearing ability of the consolidated weight-training apparatus 100, the consolidated weight-training apparatus 500, and/or the consolidated weight-training apparatus 550 and reduces the necessary length of the roller arm 304, the roller arm 704, or the roller arm 764. Further, the shape, size, and/or configuration of the collar 204 and/or the collar 604 allows the chest pad 202, the chest pad 602, the chest pad 636, and/or the chest pad 672 to be positioned in a plane that is offset from a plane of the roller 302, the roller 702, and/or the roller 752, such as relatively above the roller 302, the roller 702, and/or the roller 752. In this way, the chest pad 202, the chest pad 602, the chest pad 636, and/or the chest pad 672 is disposed further away from the roller 302, the roller 702, and/or the roller 752 with sufficient clearance while minimizing a longitudinal length of the roller arm 304, the roller arm 704, or the roller arm 764 to allow a user enhanced freedom of movement when using the consolidated weight-training apparatus 100, the consolidated weight-training apparatus 500, and/or the consolidated weight-training apparatus 550. Additionally, the shape, size, and/or configuration of the collar 204 and/or the collar 604 allows the connection joint 206 and/or the connection joint 606 to rotate the chest pad 202, the chest pad 602, the chest pad 636, and/or the chest pad 672 throughout the plurality of positions relative to the collar 204 and/or the collar 604 while maintaining ample space for the user to perform various suitable exercises along the chest pad 202, the chest pad 602, the chest pad 636, and/or the chest pad 672 and/or the roller 302, the roller 702, and/or the roller 752 without encountering any interference formed by a proximity of the other as a physical obstruction. Further, the configuration of the components of the chest support system 200, the chest support system 600, the chest support system 635, and/or the chest support system 670; the roller system 300, the roller system 700, and/or the roller system 750; and the mounting system 400 and/or the mounting system 800 aid in minimizing deflection of the chest pad 202, the chest pad 602, the chest pad 636, and/or the chest pad 672 upon the chest pad 202, the chest pad 602, the chest pad 636, and/or the chest pad 672 receiving an application of force from a user's body during use.

It should be appreciated that any of the chest pads described herein can be either rectangular or tapered. For example, the chest pad 202, the chest pad 636, and the chest pad 672 are substantially rectangular in shape, while the chest pad 602 is tapered.

Since many possible embodiments may be made of the invention without departing from the scope thereof, it is to be understood that all matter herein set forth or shown in the accompanying drawings is to be interpreted as illustrative and not in a limiting sense such that various alternative aspects for implementing the present teachings are within the scope of the claims.

The following clauses provide an exemplary configuration for an article of footwear and sole structure described above.

Clause 1. A weight-training apparatus comprising: a chest pad; a roller; a collar positioned between the chest pad and the roller, wherein the collar couples the chest pad to the roller, and wherein the chest pad is movable relative to the collar; and a mounting arm configured to couple the chest pad, the collar, and the roller to an ancillary device such that the chest pad and the roller are suspended relative to the ancillary device.

Clause 2. The weight-training apparatus of Clause 1, wherein the mounting arm is disposed at a first end of the weight-training apparatus and the chest pad is disposed at a second end of the weight-training apparatus opposite the first end, the mounting arm configured to engage the ancillary device.

Clause 3. The weight-training apparatus of Clause 1, wherein the mounting arm includes: a brace plate having a longitudinal length defined between a first bracket of the mounting arm and a second bracket of the mounting arm; a first flange extending laterally outwards from an upper portion of the mounting arm and opposite of the roller; and a second flange extending laterally outwards from a lower portion of the mounting arm and opposite of the roller.

Clause 4. The weight-training apparatus of Clause 3, wherein the first bracket of the mounting arm includes a first brace pad, and wherein the second bracket of the mounting arm includes a second brace pad.

Clause 5. The weight-training apparatus of Clause 3, further comprising a support pin fixedly attached to the mounting arm, wherein the brace plate includes a first opening configured to receive the support pin to couple the weight-training apparatus to the ancillary device.

Clause 6. The weight-training apparatus of Clause 5, further comprising a pin removably attached to the mounting arm, wherein the brace plate includes a second opening configured to receive the pin to couple the weight-training apparatus to the ancillary device.

Clause 7. The weight-training apparatus of Clause 1, further comprising a first handle extending from the collar, wherein a longitudinal length of the first handle extends perpendicular to the longitudinal axis; and a second handle extending from the mounting arm, wherein a longitudinal length of the second handle extends parallel to the longitudinal axis.

Clause 8. The weight-training apparatus of Clause 1, wherein each of the chest pad and the roller comprises a foam material.

Clause 9. The weight-training apparatus of Clause 1, wherein the collar includes a first arm and a second arm that is positioned opposite of the first arm, the first arm including one or more openings and the second arm including one or more openings, wherein each of the first arm and the second arm are substantially S-shaped.

Clause 10. The weight-training apparatus of Clause 1, further comprising a roller arm coupled with the roller, wherein the roller arm is a hollow tube and the roller arm comprises a rigid material, the rigid material comprising steel.

Clause 11. The weight-training apparatus of Clause 1, further comprising a support frame extending between a first end and a second end, the support frame including a first arm; a second arm parallel to the first arm; and one or more support braces coupling the first arm to the second arm, wherein the first end of the support frame is connected to or formed with the mounting arm, and wherein the second end of the support frame is connected to or formed with the collar.

Clause 12. The weight-training apparatus of Clause 1, further comprising a roller arm extending from a first end to a second end; a first I-beam; and a second I-beam, wherein the roller arm is coupled to the roller, wherein the roller arm is a hollow tube, wherein the first I-beam extends into the roller arm from the first end such that the first I-beam terminates closer to the first end than a center of the roller arm, wherein the second I-beam extends into the roller arm from the second end such that the second I-beam terminates closer to the second end than the center of the roller arm, and wherein the roller arm is comprised of steel.

Clause 13. A weight-training apparatus comprising: a chest support system comprising; a collar including a pair of arms, each of the pair of arms including a plurality of holes; a chest pad movably coupled to the collar via a connection joint, the connection joint including a plurality of holes; a pin disposed within corresponding holes of the plurality of holes of the pair of arms and a first hole of the plurality of holes of the connection joint; and a roller system comprising; a roller arm extending laterally outwards from the collar; and a roller circumferentially disposed around the roller arm.

Clause 14. The weight-training apparatus of Clause 13, wherein the roller includes a lumen extending through a longitudinal length of the roller, and the roller system includes a tube extending through the lumen.

Clause 15. The weight-training apparatus of Clause 14, wherein the tube is disposed around the roller arm in the lumen, and the roller is configured to rotate about the roller arm.

Clause 16. The weight-training apparatus of Clause 14, wherein the chest pad is disposed in a first plane that is parallel to a longitudinal axis of the weight-training apparatus, and wherein the roller system is disposed in a second plane that is parallel to the longitudinal axis and offset from the first plane.

Clause 17. A weight-training apparatus comprising: a chest support system, the chest support system comprising; a collar including a first arm and a second arm, the first arm including one or more openings and the second arm including one or more openings; a chest pad configured to transition between a plurality of angular positions coupled to the collar via a connection joint, the connection joint including a first opening; and a pin configured to be removed or inserted within a first opening of the one or more openings of the first arm, a first opening of the one or more openings of the second arm, and the first opening of the connection joint; a mounting arm; a roller arm extending away from the mounting arm and coupled to the collar; and a roller circumferentially disposed around the roller arm.

Clause 18. The weight-training apparatus of Clause 17, wherein the connection joint includes a second opening, a third opening, and a fourth opening.

Clause 19. The weight-training apparatus of Clause 18, wherein the first opening corresponds to a first angular position of the chest pad, the second opening corresponds to a second angular position of the chest pad, the third opening corresponds to a third angular position of the chest pad, and the fourth opening corresponds to a fourth angular position of the chest pad.

Clause 20. The weight-training apparatus of Clause 19, wherein in the first angular position, the chest pad is positioned in a parallel configuration with a longitudinal axis of the weight-training apparatus, wherein in the second angular position, the chest pad is positioned in a transverse configuration that intersects the longitudinal axis, and wherein in the third angular position, the chest pad is positioned in a perpendicular configuration relative to the longitudinal axis.

Clause 21. The weight-training apparatus of Clause 17, wherein the chest pad and the roller are each comprised of a foam material.

Clause 22. The weight-training apparatus of Clause 18, wherein the chest pad is removably attached to the collar.

Clause 23. The weight-training apparatus of Clause 17, wherein each of the first arm and the second arm of the collar are substantially S-shaped such that the chest pad is disposed in a first plane that is offset from and elevated relative to a second plane of the roller.

Clause 24. The weight-training apparatus of Clause 17, wherein the chest support system, the roller arm, the roller, and the mounting arm are securely assembled with one another via one or more fastening mechanisms.

Clause 25. The weight-training apparatus of Clause 17, the chest support system further comprising a spring-loaded tube connected to the chest pad and the collar, wherein the chest pad is configured to move away from and towards the collar, and wherein the spring-loaded tube biases the chest pad to stay in contact with the spring-loaded tube.

What is claimed is:

1. A weight-training apparatus comprising:

a chest pad;

a roller, wherein a long axis of the roller is parallel to a long axis of the chest pad;

a collar positioned between the chest pad and the roller, wherein the collar couples the chest pad to the roller, and wherein the chest pad is movable relative to the collar; and a mounting arm configured to removably couple the chest pad, the collar, and the roller to an ancillary device such that the chest pad and the roller are suspended relative to the ancillary device.

2. The weight-training apparatus of claim 1, wherein the mounting arm is disposed at a first end of the weight-training apparatus and the chest pad is disposed at a second end of the weight-training apparatus opposite the first end, the mounting arm configured to engage the ancillary device.

3. The weight-training apparatus of claim 1, wherein the mounting arm includes:

a brace plate having a longitudinal length defined between a first bracket of the mounting arm and a second bracket of the mounting arm;

a first flange extending laterally outwards from an upper portion of the mounting arm and opposite of the roller; and a second flange extending laterally outwards from a lower portion of the mounting arm and opposite of the roller.

4. The weight-training apparatus of claim 3, further comprising:

a support pin fixedly attached to the mounting arm, wherein the brace plate includes a first opening configured to receive the support pin to removably couple the weight-training apparatus to the ancillary device.

5. The weight-training apparatus of claim 4, further comprising:

a pin removably attached to the mounting arm, wherein the brace plate includes a second opening configured to receive the pin to removably couple the weight-training apparatus to the ancillary device.

6. The weight-training apparatus of claim 1, further comprising:

a first handle extending from the collar, wherein a longitudinal length of the first handle extends perpendicular to a longitudinal axis of the weight-training apparatus; and a second handle extending from the mounting arm, wherein a longitudinal length of the second handle extends parallel to the longitudinal axis.

7. The weight-training apparatus of claim 1, wherein each of the chest pad and the roller comprises a foam material.

8. The weight-training apparatus of claim 1, further comprising:

a support frame extending between a first end and a second end, the support frame including:

a first arm;

a second arm parallel to the first arm; and one or more support braces coupling the first arm to the second arm, wherein the first end of the support frame is connected to or formed with the mounting arm, and wherein the second end of the support frame is connected to or formed with the collar.

9. The weight-training apparatus of claim 1, further comprising:

a roller arm extending from a first end to a second end;

a first I-beam; and a second I-beam, wherein the roller arm is coupled to the roller, wherein the roller arm is a hollow tube, wherein the first I-beam extends into the roller arm from the first end such that the first I-beam terminates closer to the first end than a center of the roller arm, wherein the second I-beam extends into the roller arm from the second end such that the second I-beam terminates closer to the second end than the center of the roller arm, and wherein the roller arm is comprised of steel.

10. A weight-training apparatus comprising:

a chest support system comprising:

a collar including a pair of arms, each of the pair of arms including a plurality of holes;

a chest pad movably coupled to the collar via a connection joint, the connection joint including a plurality of holes; and a pin disposed within corresponding holes of the plurality of holes of the pair of arms and a first hole of the plurality of holes of the connection joint; and a roller system comprising:

a roller arm extending laterally outwards from the collar; and a roller circumferentially disposed around the roller arm, wherein a long axis of the roller is parallel to a long axis of the chest pad.

11. The weight-training apparatus of claim 10, wherein the roller includes a lumen extending through a longitudinal length of the roller, and the roller system includes a tube extending through the lumen.

12. The weight-training apparatus of claim 11, wherein the tube is disposed around the roller arm in the lumen, and the roller is configured to rotate about the roller arm.

13. The weight-training apparatus of claim 11, wherein the chest pad is disposed in a first plane that is parallel to a longitudinal axis of the weight-training apparatus, and wherein the roller system is disposed in a second plane that is parallel to the longitudinal axis and offset from the first plane.

14. A weight-training apparatus comprising:

a chest support system, the chest support system comprising:

a collar including a first arm and a second arm, the first arm including one or more openings and the second arm including one or more openings;

a chest pad configured to transition between a plurality of angular positions and coupled to the collar via a connection joint, the connection joint including a first opening; and a pin configured to be removed from or inserted within a first opening of the one or more openings of the first arm, a first opening of the one or more openings of the second arm, and the first opening of the connection joint;

a mounting arm;

a roller arm extending away from the mounting arm and coupled to the collar; and a roller circumferentially disposed around the roller arm, wherein a long axis of the roller is parallel to a long axis of the chest pad.

15. The weight-training apparatus of claim 14, wherein the connection joint includes a second opening, a third opening, and a fourth opening.

16. The weight-training apparatus of claim 15, wherein the plurality of angular positions of the chest pad comprises a first angular position, a second angular position, a third angular position, and a fourth angular position, and wherein the first opening of the connection joint corresponds to the first angular position, the second opening of the connection joint corresponds to the second angular position, the third opening of the connection joint corresponds to the third angular position, and the fourth opening of the connection joint corresponds to the fourth angular position.

17. The weight-training apparatus of claim 16, wherein in the first angular position, the chest pad is positioned in a parallel configuration with a longitudinal axis of the weight-training apparatus, wherein in the second angular position, the chest pad is positioned in a transverse configuration that intersects the longitudinal axis, and wherein in the third angular position, the chest pad is positioned in a perpendicular configuration relative to the longitudinal axis.

18. The weight-training apparatus of claim 14, wherein the chest pad is removably attached to the collar.

19. The weight-training apparatus of claim 14, wherein each of the first arm and the second arm of the collar are substantially S-shaped such that the chest pad is disposed in a first plane that is offset from and elevated relative to a second plane of the roller.

20. The weight-training apparatus of claim 14, wherein the chest support system further comprises:

a spring-loaded tube connected to the chest pad and the collar, wherein the chest pad is configured to move away from and towards the collar, and wherein the spring-loaded tube biases the chest pad to stay in contact with the spring-loaded tube.

* * * * *